US005986389A

United States Patent [19]

Tsukamoto

[11] Patent Number: 5,986,389

[45] **Date of Patent: *Nov. 16, 1999**

[54] ELECTRON-EMITTING DEVICE AS WELL AS ELECTRON SOURCE AND IMAGE-FORMING APPARATUS USING SUCH DEVICES

[75] Inventor: Takeo Tsukamoto, Atsugi, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/594,294

[22] Filed: Jan. 30, 1996

[30] Foreign Application Priority Data

Jan. 31, 1995 [JP] Japan ..... 7-032800
Jan. 26, 1996 [JP] Japan ..... 8-031214

[51] Int. Cl.[6] ..... H01J 1/30; H01J 19/10; H01J 19/24

[52] U.S. Cl. ..... 313/310; 313/309; 313/495; 313/336; 313/355

[58] Field of Search ..... 313/310, 309, 313/495, 306, 336, 355, 291, 251, 496; 315/169.1, 169.3

[56] References Cited

U.S. PATENT DOCUMENTS

| | | | |
|---|---|---|---|
| 4,940,916 | 7/1990 | Borel et al. . | |
| 4,954,744 | 9/1990 | Suzuki et al. | 313/309 |
| 5,396,150 | 3/1995 | Wu et al. . | |
| 5,594,296 | 1/1997 | Mitsutake et al. | 313/310 |

FOREIGN PATENT DOCUMENTS

| | | | |
|---|---|---|---|
| 0660357A1 | 6/1994 | European Pat. Off. | H01J 1/30 |
| 7-235255 | 9/1995 | Japan | H01J 1/30 |

OTHER PUBLICATIONS

Dyke, W.P., et al., "Field Emission", Advances in Electronics and Electron Physics, Academic Press, NY/NY, vol. VIII, 1956, pp. 89–185.

Mead, C.A., "Operation of Tunnel–Emission Devices", Journal of Applied Physics, vol. 32, No. 4, Apr. 1961, pp. 646–652.

Elinson, M.I., et al., "The Emission of Hot Electrons and the Field Emission of Electrons from Tin Oxide", Radio Engineering and Electronic Physics, vol. 7, Jul. 1965, pp. 1290–1296.

Dittmer, G., "Electrical Conduction and Electron Emission of Discontinuous Thin Films", Thin Solid Films—Elsevier Sequoia S.A., Lausanne, Switzerland, Jul. 4, 1971, pp. 317–329.

Hartwell, M., et al., "Strong Electron Emission from Patterned Tin–Indium Oxide Thin Films", international Electron Devices meeting 1975 Washington, D.C., Catalog No. 75, pp. 519–521.

Spindt, C.A., et al., "Physical properties of thin–film field emission cathodes with molybdenum cones", Journal of Applied Physics, vol. 47, No. 12, Dec. 1976.

Araki, Hisashi, et al., "Electroforming and Electron Emission of Carbon Thin Films", Journal of the Vacuum Society of Japan, vol. 26, No. 1, Sep. 24, 1981, pp. 22–29.

Kinoshita, K., The Experimental Physics Course No. 14: Surface/Fine Particle:, Kyuritu Publication, Sep. 1, 1986, p. 195.

Hayashi, C., et al., Ultrafine Particle—Creative Science and Technology, Mita Publication, 1988, p. 2, 11.1–4.

*Primary Examiner*—Sandra O'Shea
*Assistant Examiner*—Joseph Williams
*Attorney, Agent, or Firm*—Fitzpatrick, Cella, Harper & Scinto

[57] ABSTRACT

An electron-emitting device comprises a pair of electrodes and an electroconductive thin film therebetween having an electron-emitting region. The electroconductive thin film is coated with an additional film at the electron-emitting region to provide an additional resistance within a range from 500 Ω to 100 kΩ.

8 Claims, 22 Drawing Sheets

ELECTRON-EMITTING DEVICE AS WELL AS ELECTRON SOURCE AND IMAGE-FORMING APPARATUS USING SUCH DEVICES

BACKGROUND OF THE INVENTION

1. Field of the Invention

This invention relates to an electron-emitting device and, more particularly, it relates to an electron-emitting device having a stable emission current as well as to an electron source and an image-forming apparatus using such electron-emitting devices.

2. Related Background Art

There have been known two types of electron-emitting device: the thermionic type and the cold cathode type. Of these, the cold cathode type refers to devices including field emission type (hereinafter referred to as the FE type) devices, metal/insulation layer/metal type (hereinafter referred to as the MIM type) electron-emitting devices and surface conduction electron-emitting devices. Examples of FE type devices include those proposed by W. P. Dyke & W. W. Dolan, "Field Emission", Advances in Electron Physics, 8, 89 (1956) and C. A. Spindt, "Physical Properties of Thin-Film Field Emission Cathodes with Molybdenum Cones", J. Appl. Phys., 47, 5248 (1976).

Examples of MIM devices are disclosed in papers including C. A. Mead, "Operation of Tunnel-Emission Devices", J. Appl. Phys., 32, 646 (1961).

Examples of surface conduction electron-emitting devices include one proposed by M. I. Elinson, Radio Eng. Electron Phys., 10, 1290 (1965).

A surface conduction electron-emitting device is realized by utilizing the phenomenon that electrons are emitted out of a small thin film formed on a substrate when an electric current is forced to flow in parallel with the film surface. While Elinson proposes the use of an $SnO_2$ thin film for a device of this type, the use of an Au thin film is proposed in G. Dittmer, "Thin Solid Films", 9, 317 (1972) whereas the use of $In_2O_3/SnO_2$ and of a carbon thin film are discussed respectively in M. Hartwell and C. G. Fonstad, "IEEE Trans. ED Conf.", 519 (1975) and H. Araki et al., "Vacuum", Vol. 26, No. 1, p. 22 (1983).

FIG. 23 of the accompanying drawings schematically illustrates a typical surface conduction electron-emitting device proposed by M. Hartwell. In FIG. 23, reference numeral 201 denotes a substrate. Reference numeral 202 denotes an electroconductive thin film normally prepared by producing an H-shaped thin metal oxide film by means of sputtering, part of which eventually becomes an electron-emitting region 203 when it is subjected to current conduction treatment referred to as "energization forming" as will be described hereinafter. In FIG. 23, the narrow film arranged between a pair of device electrodes has a length G of 0.5 to 1 mm and a width W' of 0.1 mm.

Conventionally, an electron emitting region 203 is produced in a surface conduction electron-emitting device by subjecting the electroconductive thin film 202 of the device to a preliminary treatment, which is referred to as "energization forming". In the energization forming process, a constant DC voltage or a slowly rising DC voltage that rises typically at a rate of 1 V/min. is applied to given opposite ends of the electroconductive thin film 202 to partly destroy, deform or transform the film and produce an electron-emitting region 203 which is electrically highly resistive. Thus, the electron-emitting region 203 is part of the electroconductive thin film 202 that typically contains a fissure or fissures therein so that electrons may be emitted from the fissure. Note that, once subjected to an energization forming process, a surface conduction electron-emitting device comes to emit electrons from its electron emitting region 203 whenever an appropriate voltage is applied to the electroconductive thin film 202 to make an electric current run through the device.

Japanese Patent Application Laid-Open No. 6-141670 discloses another configuration of a surface conduction electron-emitting device. It comprises a pair of oppositely disposed device electrodes of an electroconductive material and a thin film of another electroconductive material arranged to connect the device electrodes. An electron-emitting region is produced in the electroconductive thin film when the latter is subjected to energization forming. FIGS. 2A and 2B schematically illustrate a typical known surface conduction electron-emitting device (although its configuration also applies to an electron-emitting device according to the invention which will be described hereinafter).

With such an electron-emitting device, the intensity of electron beam emitted from the device can be remarkably improved by subjecting it to a process referred to as "activation". For an activation process, the device is placed in a vacuum apparatus and a pulse voltage is applied between the device electrodes until carbon or a carbon compound is produced from a tiny amount of organic substances existing in the vacuum and deposited near the electron-emitting region to improve the electron-emitting performance of the device.

Such a device is advantageous over a device proposed by M. Hartwell because the electroconductive thin film including an electron-emitting region of the device of the above invention can be independently prepared so that a material that can be reproducibly subjected to energization forming such as electroconductive thin film composed of fine particles may be used for it. This feature provides a particularly preferable advantage when a large number of surface conduction electron-emitting devices that operate uniformly for electron emission have to be manufactured.

However, with the current technological status, the emission current Ie of a surface conduction electron-emitting device cannot be satisfactorily controlled so as not to show any inadmissible fluctuations. In other words, the intensity of electron beam emitted from a surface conduction electron-emitting device is incessantly fluctuating and, in a surface conduction electron-emitting device of the above-mentioned another configuration, the ratio of the average emission current <Ie> to the deviation ΔIe is about 10% after a stabilization process, which will be described hereinafter.

Obviously, the ratio has to be made as small as possible in order to finely control the intensity of electron beam emitted from a surface conduction electron-emitting device as such a finely controllable device will find a broader scope of application.

The electron-emitting performance of a surface conduction electron-emitting device can show a sort of memory effect that the performance is irreversibly changed depending on the highest voltage that has been applied to the device. Fluctuations in the emission current Ie can be accompanied by fluctuations in the effective voltage applied to the electron-emitting region of the device and hence the electron emitting performance of a surface conduction electron-emitting device can be changed when a high voltage is applied to it as a result of such fluctuations in the effective voltage and gradually degraded in the course of time if the application of such a high voltage is repeated.

Conceivable causes of such fluctuations in the emission current Ie that lead to a degraded electron-emitting performance include (1) changes in the work function due to adsorption and desorption of gas molecules remaining in the vacuum to the electron-emitting region, (2) deformation of the electron-emitting region due to ion bombardments and (3) diffusion and movements of atoms of the electron-emitting region.

Techniques for suppressing such fluctuations in the emission current Ie and consequent degradation of conduction electron-emitting device that have been proposed to date include the use of an external resistor connected in series to the device. However, when it comes to an electron source prepared by arranging a large number of electron-emitting devices, the use of a single external resistor connected in series to it cannot sufficiently nor satisfactorily suppress fluctuations in the emission current Ie of each of the electron-emitting devices.

An improvement to this technique may consist in the use of a plurality of resistors respectively connected to the electron-emitting devices of the electron source. However, it is not feasible to equalize the resistances of a large number of resistors and the use of resistors with uneven resistances can boost the deviations that exist in the performance of individual electron-emitting devices. Additionally, once the resistors are connected to the electron-emitting devices, the former have to be subjected to an energization forming process with the latter to baffle any efforts for optimizing the energization forming.

In view of the above identified problems, therefore, there has been a demand for electron-emitting devices provided with respective appropriate resistors that can be formed after an energization forming operation as well as a method of manufacturing such devices.

SUMMARY OF THE INVENTION

It is therefore an object of the present invention to provide an electron-emitting device with reduced fluctuations in the emission current.

It is another object of the invention to provide an electron-emitting device that is less prone to degradation in the electron-emitting performance.

According to an aspect of the present invention, there is provided an electron-emitting device comprising a pair of device electrodes and an electroconductive thin film therebetween having an electron-emitting region, said electroconductive thin film being coated with an additional film at the electron-emitting region to provide an additional resistance within a range from 500 Ω to 100 kΩ.

According to another aspect of the present invention, there is provided an electron source comprising a plurality of electron-emitting devices arranged as connected to wires on a substrate, wherein the electron-emitting devices are those as described above.

According to still another aspect of the present invention, there is provided an image-forming apparatus comprising an electron source formed by arranging a plurality of electron-emitting devices as connected to wires on a substrate and an image-forming member for producing images upon being irradiated by electron beams emitted from said electron source, wherein the electron-emitting devices are those as described above.

DETAILED DESCRIPTION OF THE PREFERRED EMBODIMENTS

Figure 1A:
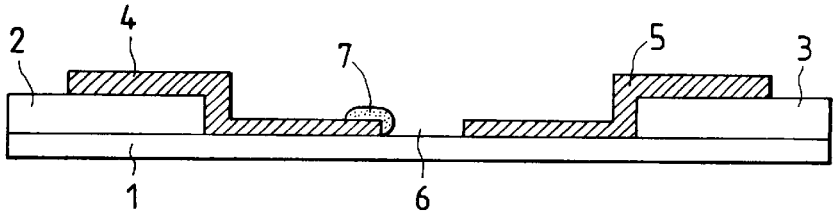
FIGS. 1A through 1H are schematic cross sectional side views of a surface conduction electron-emitting device according to the invention, showing possible different configurations of one or more than one additional films.

According to a first aspect of the invention, there is provided a surface conduction electron-emitting device comprising an electroconductive thin film having an electron-emitting region and coated with an additional film at least on the lower potential side of the boundary of the electron-emitting region to provide an additional resistance. Such an additional film may also be arranged on the higher potential side of the boundary of the electron-emitting region. Such an additional film is formed to provide an additional resistance within a range from 500 Ω to 100 kΩ between the oppositely disposed device electrode when the device is driven to emit electrons.

It should be noted here that a field emission type electron-emitting device (FE device) also shows fluctuations in the emission current Ie 'and there has been proposed a technique of arranging an additional resistor layer under the cathodic component in order to eliminate such fluctuations. In the case of an FE device, the additional resistance to be used to control the emission current of the device is typically set to a level between 1 MΩ or so and several tens of MΩ relative to the emission current of somewhere around 0.1 to 1 $\mu$A in view of the fact that the emission current is dominant in the overall electric current that runs through the device.

Now, as for a surface conduction electron-emitting device, the emission current Ie is small relative to the overall current If that runs through the device. In a typical example, an Ie of about 1 $\mu$A is generated for an If having a magnitude of 1 mA. As a result of intensive research efforts, the inventors of the present invention discovered that, by adding an appropriate additional resistance that matches the If level of the device, fluctuations in the If and hence those in the Ie can be effectively suppressed. While the suppression effect becomes remarkable with a large additional resistance, such a large additional resistance incidentally gives rise to a voltage drop greater than 100 V to consequently raise the voltage required to drive the device if it exceeds 100 kΩ. Therefore, the use of an excessively large additional resistance is not feasible.

An electron-emitting device according to the invention may further comprises a film of carbon or a carbon compound produced as a result of an activation process. For the purpose of the present invention, such a film of carbon or a carbon compound may well be formed on a film for providing an additional resistance as described above or, alternatively, a film for providing an additional film may well be formed on a film of carbon or a carbon compound that has been formed on the electroconductive thin film. For the purpose of activation, a film of carbon or a carbon compound may be replaced by a metal film. If such is the case, it is possible to suppress the possible degradation in the performance of the electron-emitting device due to deformation or transformation of the electroconductive film by using a metal having a high melting point such as W, Mo or Nb. Alternatively, the emission current can be improved by using an alkaline earth metal that shows a low work function.

In an electron source realized by arranging a large number of electron-emitting devices on a substrate, the additional resistance is preferably made greater than the resistance of the wires connecting the devices.

Now, the present invention will be described further by referring to the accompanying drawings. The present invention is applicable to both plane type surface conduction electron-emitting devices and step type surface conduction electron-emitting devices. Firstly, a plane type device will be described.

Figure 2A:
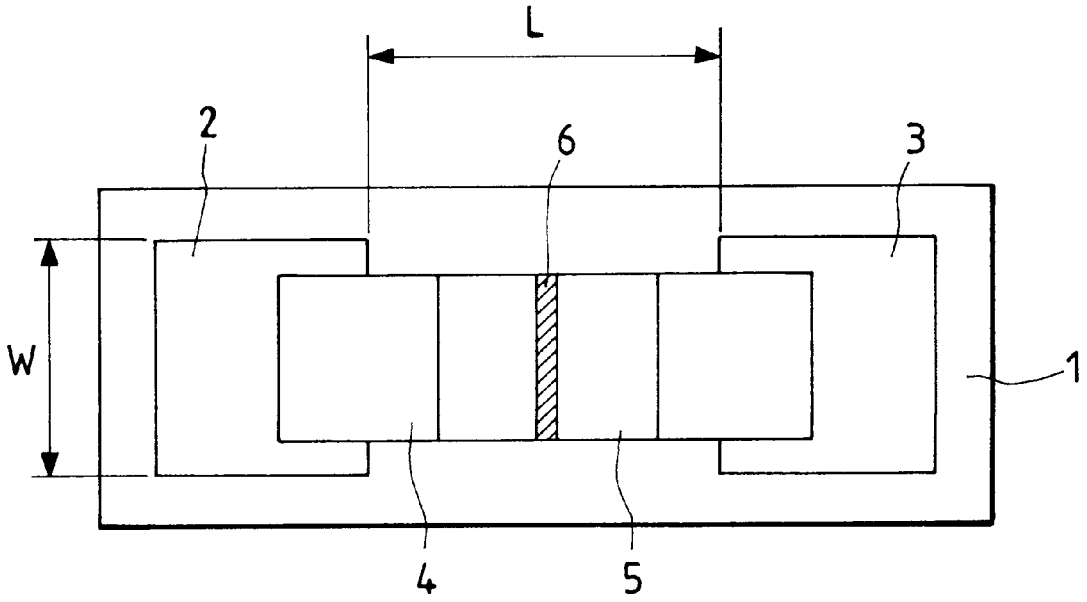
FIG. 2A is a schematic plan view of a plane type surface conduction electron-emitting device according to the invention.
Figure 2B:
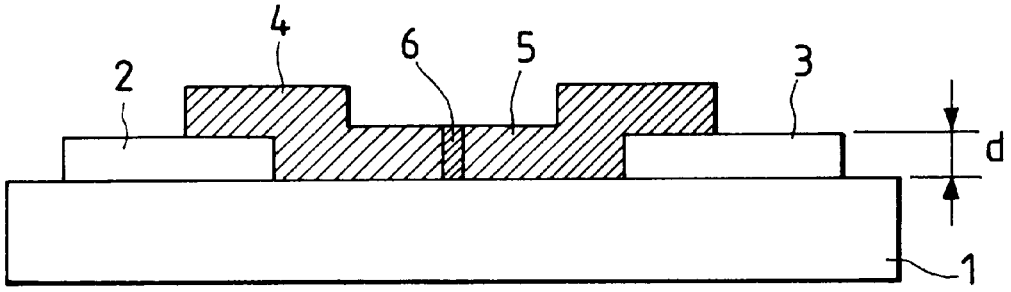
FIG. 2B is a schematic cross-sectional side view of the device of FIG. 2A.

FIGS. 2A and 2B schematically shows a plane type surface conduction electron-emitting device to which the present invention can be applied. A plan view is shown in FIG. 2A, while FIG. 2B shows a cross sectional view.

Referring to FIGS. 2A and 2B, the device comprises a substrate 1, a low potential side device electrode and a high potential side device electrode 2 and 3, a low potential side electroconductive thin film and a high potential side electroconductive thin film 4 and 5 and an electron-emitting region 6.

Materials that can be used for the substrate 1 include quartz glass, glass containing impurities such as Na to a reduced concentration level, soda lime glass, glass substrate realized by forming an $SiO_2$ layer on soda lime glass by means of sputtering, and ceramic substances such as alumina as well as Si.

While the oppositely arranged device electrodes 2 and 3 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, Au, $RuO_2$, Pd—Ag, etc., in conbination with glass, transparent conducting materials such as $In_2O_3$—$SnO_2$ and semiconductor materials such as polysilicon.

The distance L separating the device electrodes, the length W of the device electrodes, the contours of the electroconductive films 4 and 5 and other factors for designing a surface conduction electron-emitting device according to the invention may be determined depending on the application of the device. The distance L separating the device electrodes 2 and 3 is preferably between hundreds nanometers and hundreds micrometers and, still preferably, between several micrometers and tens of several micrometers.

The length W of the device electrodes is preferably between several micrometers and several hundreds of micrometers depending on the resistance of the electrodes and the electron-emitting characteristics of the device. The film thickness d of the device electrodes 2 and 3 is between several tens of nanometers and several micrometers.

A surface conduction electron-emitting device according to the invention may have a configuration other than the one illustrated in FIGS. 2A and 2B and, alternatively, it may be prepared by laying thin films 4 and 5 on a substrate 1 and then a pair of oppositely disposed device electrodes 2 and 3 on the thin film.

The electroconductive thin films 4 and 5 are preferably fine particle films in order to provide excellent electron-emitting characteristics. The thickness of the electroconductive thin films is determined as a function of the stepped coverage of the electroconductive thin films on the device electrodes 2 and 3, the electric resistance between the device electrodes 2 and 3 and the parameters for the forming operation that will be described later as well as other factors and preferably between several tenth of a nanometer and several hundreds of nanometers and more preferably between a nanometer and fifty nanometers. The electroconductive thin films 4 and 5 normally shows a sheet resistance Rs between $10^2$ and $10^7$Ω/□. Note that Rs is the value defined by R=Rs(l/w), where w and 1 are the width and the length of a thin film respectively and R is the resistance determined along the longitudinal direction of the thin film. Also note that, while the forming process is described in terms of current conduction treatment for the purpose of the present invention, it is not limited thereto and may include a process where a fissure is formed in the thin film to produce a high resistance state there.

The electroconductive thin films 4 and 5 are made of a material selected from metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such TiC, ZrC, HfC, TaC, SiC and WC, nitrides such as TiN, ZrN and HfN, and so forth.

The term a "fine particle film" as used herein refers to a thin film constituted of a number of fine particles that may be loosely dispersed, tightly arranged or mutually and randomly overlapping (to form an island structure under certain conditions). The diameter of fine particles to be used for the purpose of the present invention is between several tenths of a nanometer and several hundreds of nanometers and preferably between a nanometer and twenty nanometers.

Since the term "fine particle" is frequently used herein, it will be described in greater depth below.

A small particle is referred to as a "fine particle" and a particle smaller than a fine particle is referred to as an "ultrafine particle". A particle smaller than an "ultrafine particle" and constituted by several hundred atoms is referred to as a "cluster".

However, these definitions are not rigorous and the scope of each term can vary depending on the particular aspect of the particle to be dealt with. An "ultrafine particle" may be referred to simply as a "fine particle" as in the case of this patent application.

"The Experimental Physics Course No. 14: Surface/Fine Particle" (ed., Koreo Kinoshita; Kyoritu Publication, Sep. 1, 1986) describes as follows:

"A fine particle as used herein referred to a particle having a diameter somewhere between 2 to 3 $\mu$m and 10 nm and an ultrafine particle as used herein means a particle having a diameter somewhere between 10 nm and 2 to 3 nm. However, these definitions are by no means rigorous and an ultrafine particle may also be referred to simply as a fine particle. Therefore, these definitions are a rule of thumb in any means. A particle constituted of two to several hundreds of (or tens of) atoms is called a cluster." (Ibid., p.195, 11.22–26)

Additionally, "Hayashi's Ultrafine Particle Project" of the New Technology Development Corporation defines an "ultrafine particle" as follows, employing a smaller lower limit for the particle size:

"The Ultrafine Particle Project (1981–1986) under the Creative Science and Technology Promoting Scheme defines an ultrafine particle as a particle having a diameter between about 1 and 100 nm. This means an ultrafine particle is an agglomerate of about 100 to $10^8$ atoms. From the viewpoint of atom, an ultrafine particle is a huge or ultrahuge particle." ("Ultrafine Particle—Creative Science and Technology": ed., Chikara Hayashi, Ryoji Ueda, Akira Tazaki; Mita Publication, 1988, p.2, 11.1–4) "A particle smaller than an ultrafine particle and constituted by several to several hundred atoms is referred to as a cluster. (Ibid., p.2, 11.12–13)

Taking the above general definitions into consideration, the term "a fine particle" as used herein refers to an agglomerate of a large number of atoms and/or molecules having a diameter with a lower limit between several tenths of a nanometer and a nanometer and with an upper limit of several micrometers.

The electron-emitting region 6 is formed between the lower potential side and higher potential side electroconductive thin films 4 and 5 and comprises an electrically highly resistive fissure, although its performance is dependent on the thickness, nature and material of the electroconductive thin films 4 and 5 and the energization forming process which will be described hereinafter. The electron emitting region 6 may contain in the inside electroconductive fine particles having a diameter between a tenth of several nanometers and tens of several nanometers. The material of such electroconductive fine particles may be selected from all or part of the materials that can be used to prepare the electroconductive thin films 4 and 5.

FIGS. 1A through 1H are schematic cross sectional side views of a surface conduction electron-emitting device according a first aspect of the invention, showing typical different configurations.

FIG. 1A shows the most basic configuration of an additional film 7 for providing an additional resistance formed on the border of the electron-emitting region 6 and the lower potential side electroconductive thin film 4 of an electron-emitting device according to the invention. The device can be made to perform in a desired way by appropriately selecting a thickness, a profile and a resistivity for the film to provide a desired additional resistance.

Materials that can be used for the additional film include semiconductor substances such as Si and Ge and metal oxides. When a semiconductor substance is used, the resistivity of the film can be regulated by selecting an appropriate concentration for each of the impurities it contains. When a metal oxide is used, the resistivity of the film can be regulated by controlling the deviation of the oxygen content from the stoichiometric composition of the compound or by forming a mixture of a metal and an oxide with a controlled mixing ratio.

While the structure of the electron-emitting region 6 is not detailedly shown, it may contain fine particles dispersed in it.

Figure 1B:
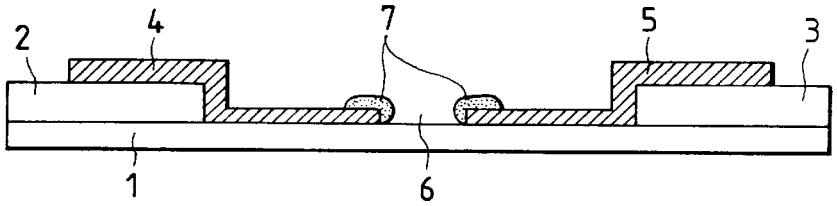

In FIG. 1B, an additional film 7 is also formed on the border of the electron-emitting region 6 and the higher potential side electroconductive thin film 5 to provide an additional resistance. This configuration is also feasible.

Figure 1C:
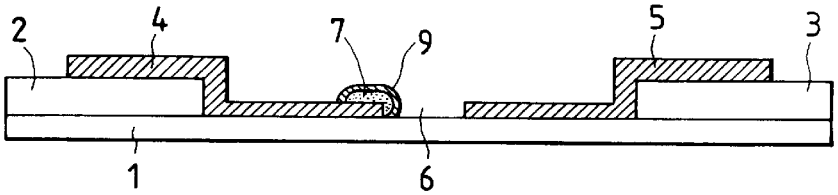
Figure 1D:
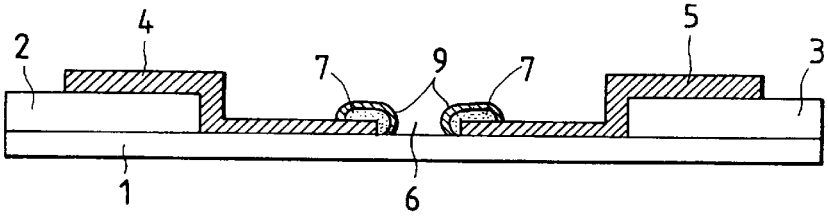

In FIG. 1C, a metal film 9 is formed in an activation process on an additional film 7 formed on the border of the electron-emitting region 6 and the lower potential side electroconductive thin film 4 to provide an additional resistance. Note that two films are formed only on the lower potential side of the device in FIG. 1C, such films may also be formed on the border of the electron-emitting region 6 on the higher potential side as in the case of FIG. 1D.

With an activation process, a metal film or a film of carbon or a carbon compound, which will be described hereinafter, is formed to remarkably increase the device current If that runs through an electron-emitting device and the emission current Ie produced by electrons emitted from the device. Thus, this particular configuration is important in terms of the scope of application of the present invention.

Figure 1E:
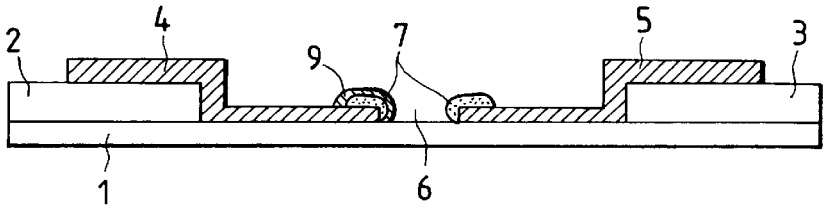

In FIG. 1E, additional films 7 are respectively formed on the border of the electron-emitting region and the lower potential side electroconductive thin film and on that of the electron-emitting region and the higher potential side electroconductive thin film to provide an additional resistance and then a metal film 9 is formed only on one of the additional films (e.g. the one on the lower potential side as in FIG. 1E).

Figure 1F:
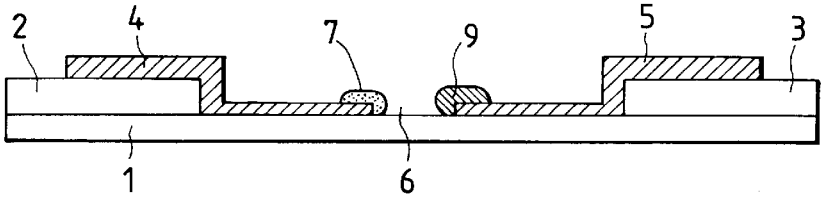

In FIG. 1F, an additional film 7 is formed on the border of the electron-emitting region 6 and the lower potential side electroconductive thin film 4 to provide an additional resistance and a metal film 9 is formed on the border of the electron-emitting region 6 and the higher potential side electroconductive thin film 5.

Figure 1G:
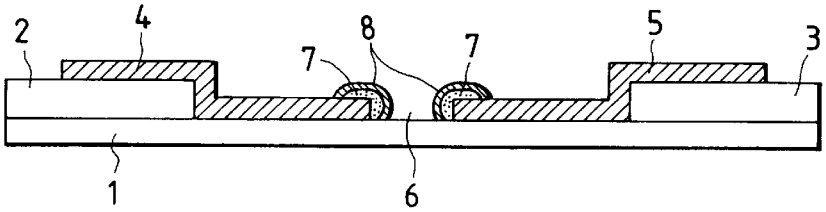

In FIG. 1G, additional films 7 are respectively formed on the border of the electron-emitting region and the lower potential side electroconductive thin film and on that of the electron-emitting region and the higher potential side electroconductive thin film to provide an additional resistance as in FIG. 1B and then they are respectively covered by films 8 of carbon or a carbon compound in an activation process.

Figure 1H:
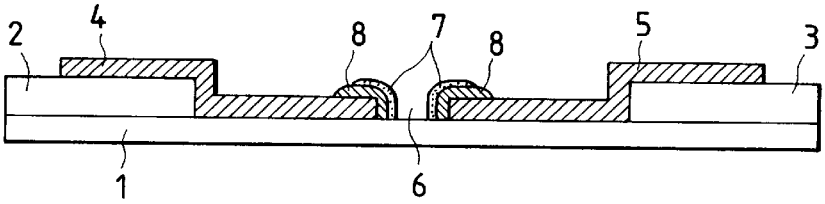

In FIG. 1H, additional films 7 for providing an additional resistance and the corresponding films 8 of carbon or a carbon compound are laid conversely relative to those of FIG. 1G.

While an additional film 7 for providing an additional resistance and a film 8 of carbon or a carbon compound are formed on both the lower potential side and the higher potential side in FIGS. 1G and 1H, the additional film 7 for providing an additional resistance on the higher potential side and/or either one of the films 8 of carbon or a carbon compound may be omitted.

It should be noted that the possible configurations of one or more than one additional films according to the invention are not limited to those illustrated in FIGS. 1A through 1H and many other configurations may be conceivable to solve the problem identified earlier.

Now, a step type surface conduction electron-emitting device, will be described.

Figure 3:
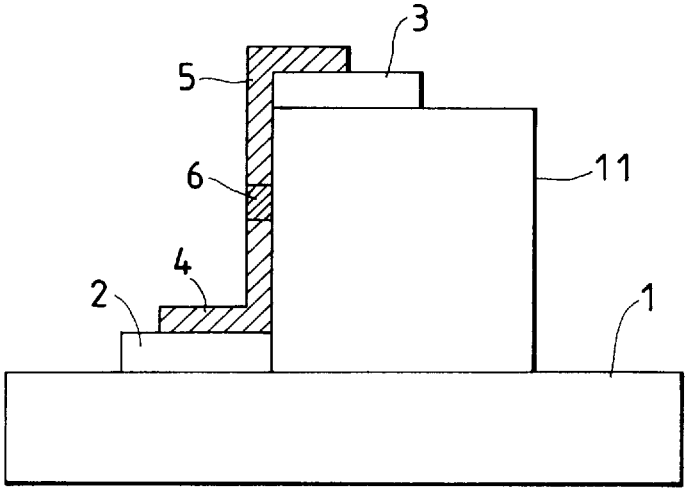
FIG. 3 is a schematic cross-sectional side view of a step type surface conduction electron-emitting device according to the invention.

FIG. 3 is a schematic sectional side view of a step type surface conduction electron emitting device, to which the present invention is applicable.

In FIG. 3, reference symbol 11 denotes a step-forming section. The device comprises a substrate 1, device electrodes 2 and 3 and electroconductive thin films 4 and 5 and an electron emitting region 6, which are made of materials same as a flat (plane) type surface conduction electron-emitting device as described above, as well as a step-forming section 11 made of an insulating material such as $SiO_2$ produced by vacuum evaporation, printing or sputtering and having a height corresponding to the distance L separating the device electrodes of a flat type surface conduction electron-emitting device as described above, or between several hundred nanometers and several tens of micrometers. Preferably, the height of the step-forming section 11 is between several tens of nanometers and several micrometers, although it is selected as a function of the method of producing the step-forming section used there and the voltage to be applied to the device electrodes.

After forming the device electrodes 2 and 3 and the step-forming section 11, the electroconductive thin films 4 and 5 are respectively laid on the device electrodes 2 and 3. While the electron-emitting region 6 is formed on the step-forming section 11 in FIG. 3, its location and contour are dependent on the conditions under which it is prepared, the energization forming conditions and other related conditions and not limited to those shown there.

Figure 4A:
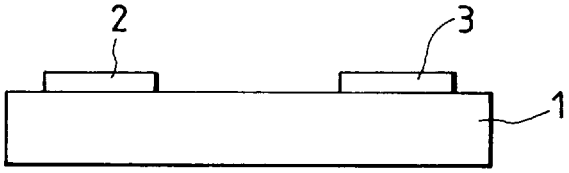
FIGS. 4A through 4C are schematic cross-sectional side views of a surface conduction electron-emitting device according to the invention, showing different manufacturing steps.
Figure 4B:
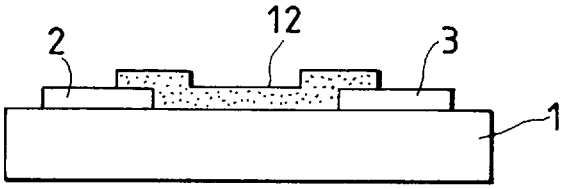
Figure 4C:
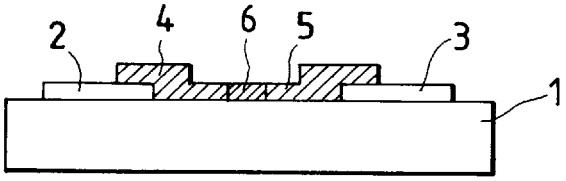

While various methods may be conceivable for manufacturing a surface conduction electron-emitting device according to the invention, FIGS. 4A through 4C schematically illustrate a typical one of such methods.

Now, a method of manufacturing a flat type surface conduction electron-emitting device according to the invention will be described by referring to FIGS. 2A and 2B and 4A through 4C. Note that, in FIGS. 4A through 4C, components same as or similar to those of FIGS. 2A and 2B are respectively denoted by same reference symbols.

1) After thoroughly cleansing a substrate 1 with detergent, pure water, organic solvent, etc., a material is deposited on the substrate 1 by means of vacuum evaporation, sputtering or some other appropriate technique for a pair of device electrodes 2 and 3, which are then produced by photolithography (FIG. 4A).

2) An organic metal thin film is formed on the substrate 1 carrying thereon the pair of device electrodes 2 and 3 by applying an organic metal solution and leaving the applied solution for a given period of time. The organic metal solution may contain as a principal ingredient any of the metals listed above for the electroconductive thin films 4 and 5. Thereafter, the organic metal thin film is heated, baked and subsequently subjected to a patterning operation, using an appropriate technique such as lift-off or etching, to produce an electroconductive thin film 12 (FIG. 4B). While an organic metal solution is used to produce thin films in the above description, an electroconductive thin film 12 may alternatively be formed by vacuum evaporation, sputtering, chemical vapor deposition, dispersion coating, dipping, spinner coating or some other technique.

3) Thereafter, the device is subjected to a process referred to as "forming".

Figure 6:
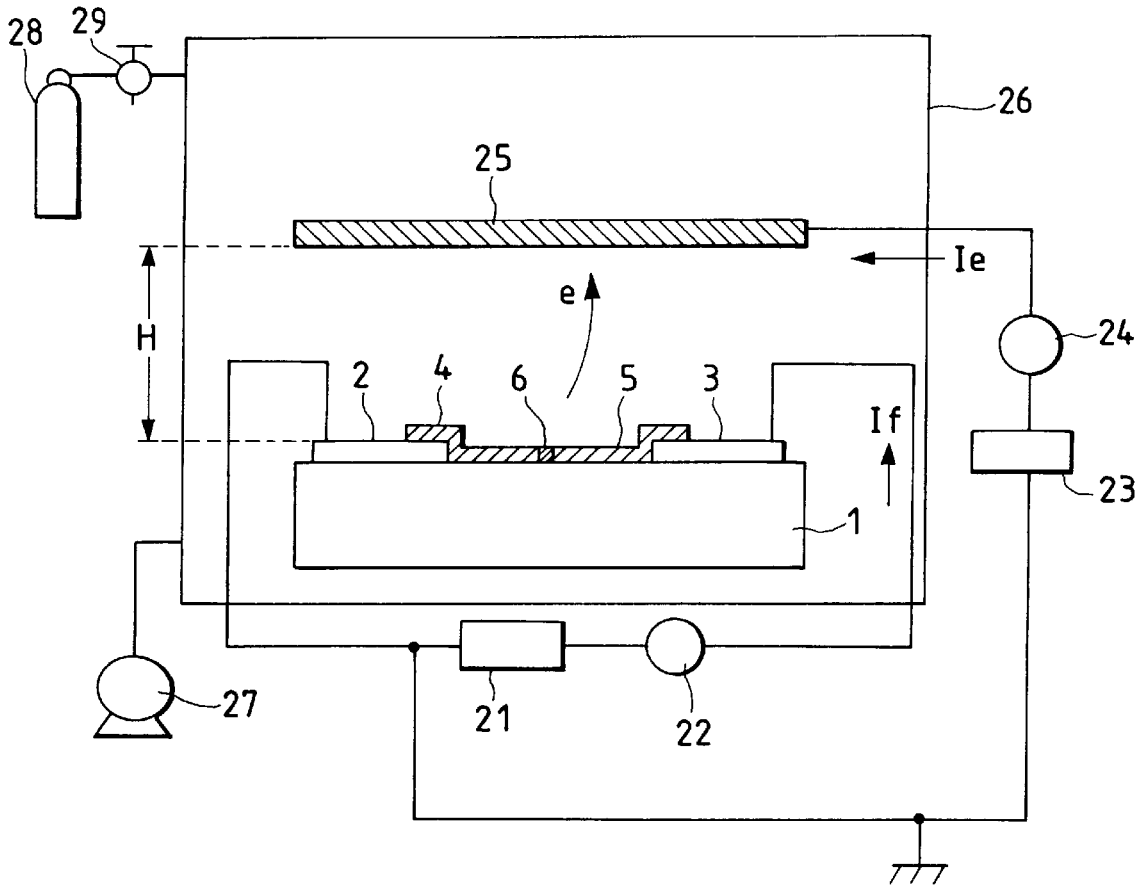
FIG. 6 is a schematic diagram of a vacuum processing apparatus that can be used for manufacturing a surface conduction electron-emitting device according to the invention and evaluating the performance of the device.

FIG. 6 is a schematic block diagram of an arrangement comprising a vacuum chamber that can be used for the "forming" process and the subsequent processes. It can also be used as a gauging system for determining the performance of an electron emitting device of the type under consideration. Referring to FIG. 6, the gauging system includes a vacuum chamber 26 and a vacuum pump 27. An electron-emitting device is placed in the vacuum chamber 26. The device comprises a substrate 1, lower and higher potential side device electrodes 2 and 3, lower and higher potential side electroconductive thin films 4 and 5 and an electron-emitting region 6. Otherwise, the gauging system has a power source 21 for applying a device voltage Vf to the device, an ammeter 22 for metering the device current If running through the thin films 4 and 5 between the device electrodes 2 and 3, an anode 25 for capturing the emission current Ie produced by electrons emitted from the electron-emitting region 6 of the device, a high voltage source 23 for applying a voltage to the anode 25 of the gauging system and another ammeter 24 for metering the emission current Ie produced by electrons emitted from the electron-emitting region 6 of the device. For determining the performance of the electron-emitting device, a voltage between 1 and 10 kV may be applied to the anode, which is spaced apart from the electron emitting device by distance H which is between 2 and 8 mm.

Instruments including a vacuum gauge and other pieces of equipment necessary for the gauging system are arranged in the vacuum chamber 26 so that the performance of the electron-emitting device or the electron source in the chamber may be properly tested. The vacuum pump 27 may be provided with an ordinary high vacuum system comprising a turbo pump and a rotary pump and an ultra-high vacuum system comprising an ion pump. The entire vacuum chamber containing an electron source substrate therein can be heated by means of a heater (not shown). Thus, this vacuum processing arrangement can be used for the "forming"

process and the subsequent processes. Reference numeral 28 denotes a substance source for storing a substance to be introduced into the vacuum chamber whenever necessary. It may be an ampule or a bomb. Reference numeral 29 denotes a valve to be used to regulate the rate of supplying the substance into the vacuum chamber.

Figure 5A:
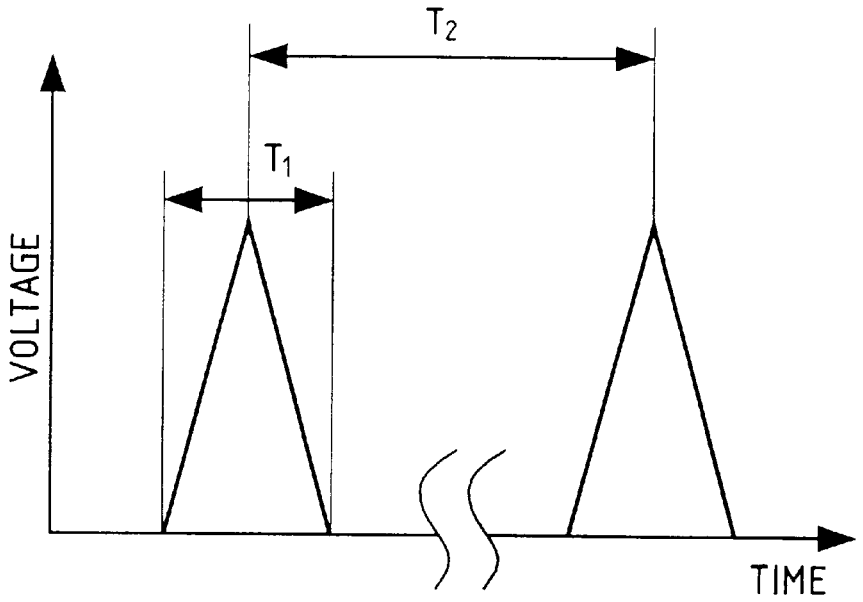
FIGS. 5A and 5B are graphs showing voltage waveforms that can be used in the process of manufacturing an electron-emitting device according to the invention.
Figure 5B:
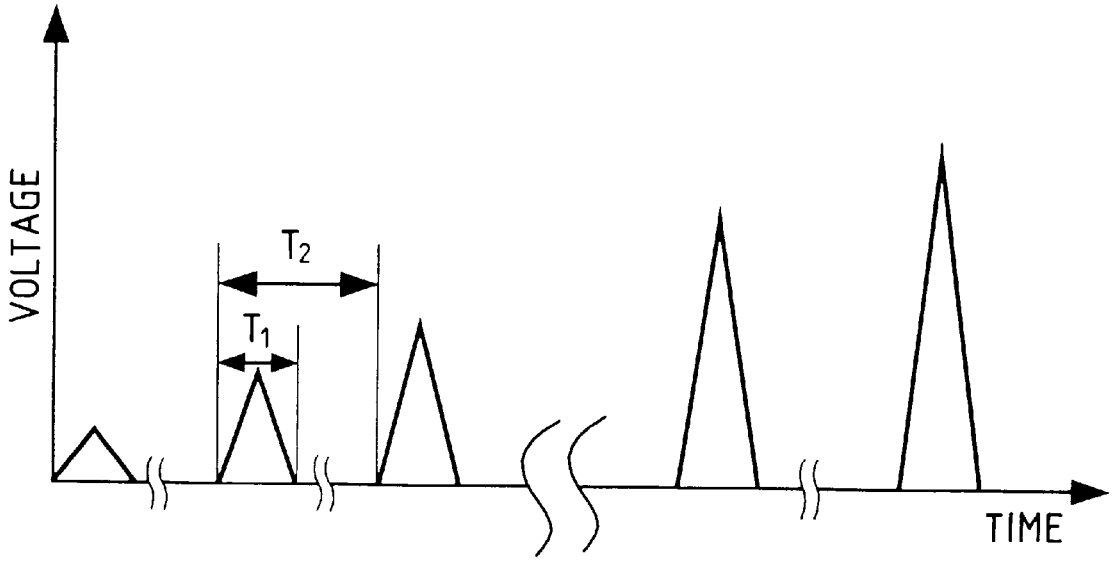

Here, an energization forming process will be described as a choice for "forming". More specifically, a voltage is applied between the device electrodes 2 and 3 by means of a power source (not shown) until an electron emitting region 6 (FIG. 4C) is produced in a given area of the electroconductive thin film 12 (FIG. 4B) to show a modified structure that is different from that of the electroconductive thin film 12. In other words, the electroconductive thin film 12 is locally and structurally destroyed, deformed or transformed to produce an electron emitting region 6 as a result of an energization forming process. FIGS. 5A and 5B shows two different pulse voltages that can be used for energization forming.

The voltage to be used for energization forming preferably has a pulse waveform. A pulse voltage having a constant height or a constant peak voltage may be applied continuously as shown in FIG. 5A or, alternatively, a pulse voltage having an increasing height or an increasing peak voltage may be applied as shown in FIG. 5B.

In FIG. 5A, the pulse voltage has a pulse width T1 and a pulse interval T2, which are typically between 1 $\mu$sec. and 10 msec. and between 10 $\mu$sec. and 100 msec. respectively. The height of the triangular wave (the peak voltage for the energization forming operation) may be appropriately selected depending on the profile of the surface conduction electron-emitting device. The voltage is typically applied for several seconds to tens of several minutes. Note, however, that the pulse waveform is not limited to triangular and a rectangular or some other waveform may alternatively be used.

FIG. 5B shows a pulse voltage whose pulse height increases with time. In FIG. 5B, the pulse voltage has an width T1 and a pulse interval T2 that are substantially similar to those of FIG. 5A. The height of the triangular wave (the peak voltage for the energization forming operation) is increased at a rate of, for instance, 0.1 V per step.

The energization forming operation will be terminated by measuring the current running through the device electrodes when a voltage that is sufficiently low and cannot locally destroy or deform the electroconductive thin film 12 is applied to the device during an interval of the pulse voltage. Typically the energization forming operation is terminated when a resistance greater than 1 MΩ is observed for the device current running through the electroconductive thin film while applying a voltage of approximately 0.1 V to the device electrodes.

4) After the energization forming operation, a film 7 is formed to provide an additional resistance on the border of the electron-emitting region 6 and the lower potential side electroconductive thin film 4. If necessary, another film may be formed on the border of the electron-emitting region and the higher potential side electroconductive thin film 5.

The vacuum chamber 26 is evacuated further by a vacuum pump 27 to reduce the internal pressure equal to or lower than $10^{-3}$ Pa. When Si is used for the film 7, vapor of a silicon compound such as $SiCl_4$, $SiH_2Cl_2$, $SiHCl_3$ or $SiH_4$ is introduced into the vacuum chamber 26 and a pulse voltage is applied between the device electrodes 2 and 3 to gradually deposit Si. The film formed by deposition can be qualitatively improved and stabilized by heating the film appropriately.

Note that, assuming a number of electron-emitting devices are collectively subjected to an above described process of forming a semiconductor film (as in the case of producing an electron source, which will be described hereinafter) on each device and the devices originally show uneven resistances, an electric current runs at an enhanced rate through a device originally having a low resistance to form a relatively thick film there and provide a greater additional resistance. Consequently, the devices come to show resistances that are close to each other to the benefit of the performance of the electron source.

When a metal oxide is used for the film 7, a highly volatile metal compound may preferably be used with oxygen gas having an appropriate partial pressure so that the metal oxide may be deposited easily when a pulse voltage is applied.

Alternatively, nitrogen gas or ammonia gas may be introduced into the vacuum chamber with a metal compound to deposit a metal nitride. Still alternatively, a metal carbide may be formed by deposition by introducing a hydrogen carbide gas such as $CH_4$.

Highly volatile metal compounds that can be used for the purpose of the invention include halogenated metals and organic metal compounds. More specifically, $AlCl_3$, $TiCl_4$, $ZrCl_4$, $TaCl_5$, $MoCl_5$, $WF_6$, triisobutylaluminum, dimethylaluminumhydride, monomethylaluminumhydride, $Mo(Co)_6$, $W(CO)_6$ and $(PtCl_2)_2(CO)_3$ provide appropriate candidate compounds.

5) Subsequently, the device is preferably subjected to an activation process. An activation process is a process by means of which the device current If and the emission current Ie are changed remarkably.

In an activation process, a pulse voltage may be repeatedly applied to the device as in the case of energization forming process in an atmosphere of the gas of an organic substance. The atmosphere may be produced by utilizing the organic gas remaining in a vacuum chamber after evacuating the chamber by means of an oil diffusion pump or a rotary pump or by sufficiently evacuating a vacuum chamber by means of an ion pump and thereafter introducing the gas of an organic substance into the vacuum. The gas pressure of the organic substance is determined as a function of the profile of the electron-emitting device to be treated, the profile of the vacuum chamber, the type of the organic substance and other factors. Organic substances that can be suitably used for the purpose of the activation process include aliphatic hydrocarbons such as alkanes, alkenes and alkynes, aromatic hydrocarbons, alcohols, aldehydes, ketones, amines, organic acids such as phenol, carboxylic acids and sulfonic acids. Specific examples include saturated hydrocarbons expressed by general formula $C_nH_{2n+2}$ such as methane, ethane and propane, unsaturated hydrocarbons expressed by general formula $C_nH_{2n}$ such as ethylene and propylene, benzene, toluene, methanol, ethanol, formaldehyde, acetaldehyde, acetone, methyl ethyl ketone, methylamine, ethylamine, phenol, formic acid, acetic acid and propionic acid and the mixture of these. As a result of an activation process, carbon or a carbon compound is deposited on the device out of the organic substances existing in the atmosphere to remarkably change the device current If and the emission current Ie.

The time of terminating the activation process is determined appropriately by observing the device current If and the emission current Ie. The pulse width, the pulse interval and the pulse wave height of the pulse voltage to be used for the acctivation process will be appropriately selected.

For the purpose of the invention, carbon and carbon compounds include graphite (namely HOPG, PG and GC, of which HOPG has a substantially perfect graphite crystalline structure and PG has a somewhat distorted crystalline structure with an average crystal grain size of 200 angstroms, while the crystalline structure of GC is further distorted with an average crystal grain size as small as 20 angstroms) and noncrystalline carbon (refers to amorphous carbon and a mixture of amorphous carbon and fine crystal grains of graphite) and the thickness of the deposited film is preferably less than 50 nanometers, more preferably less than 30 nm. For the activation process, a carbon compound such as hydrocarbons may be used in place of graphite.

In the activation process, a metal film 9 may be formed in place of a film of carbon or a carbon compound. For the metal film, a metal having a high melting point and a low work function may preferably used. Such a metal film 9 may be formed by introducing vapor of a compound of the metal into the vacuum chamber and applying a pulse voltage between the device electrodes 2 and 3 of the device to be processed. Metals that can be used for an activation process include halogenated or organic compounds of W and Mo. Specific examples of such compounds include $TaCl_5$, $MoCl_5$, $WF_6$, $Mo(CO)_6$, $W(CO)_6$, $(PtCl_2)_2(CO)_3$.

Note that the sequence of conducting the activation process of forming a film of carbon, a carbon compound or a metal and the process of forming a film for providing an additional resistance may be reversed.

5) An electron-emitting device that has been treated in an energization forming process and an activation process is then preferably subjected to a stabilization process. This is a process for removing any organic substances remaining in the vacuum chamber. The vacuuming and exhausting equipment to be used for this process preferably does not involve the use of oil so that it may not produce any evaporated oil that can adversely affect the performance of the treated device during the process. Thus, the use of a sorption pump and an ion pump may be a preferable choice.

If an oil diffusion pump or a rotary pump is used for the activation process and the organic gas produced by the oil is also utilized, the partial pressure of the organic gas has to be minimized by any means. The partial pressure of the organic gas in the vacuum chamber is preferably lower than $1\times10^{-6}$ Pa and more preferably lower than $1\times10^{-8}$ Pa if no carbon or carbon compound is additionally deposited. The vacuum chamber is preferably evacuated after heating the entire chamber so that organic molecules adsorbed by the inner walls of the vacuum chamber and the electron-emitting device in the chamber may also be easily eliminated. While the vacuum chamber is preferably heated to 80° C. or above, preferably to 150° C. or above, for as long as possible, other heating conditions may alternatively be selected depending on the size and the profile of the vacuum chamber and the configuration of the electron-emitting device in the chamber as well as other considerations. The pressure in the vacuum chamber needs to be made as low as possible and it is preferably lower than $1\times10^{-5}$ Pa and more preferably lower than $1.3\times10^{-6}$ Pa, although some other level of pressure may appropriately be selected.

After the stabilization process, the atmosphere for driving the electron-emitting device or the electron source is preferably same as the one when the stabilization process is completed, although a lower vacuum degree may alternatively be used without damaging the stability of operation of the electron-emitting device or the electron source if the organic substances in the chamber are sufficiently removed.

By using such a vacuum atmosphere, the formation of any additional deposit of carbon or a carbon compound can be effectively suppressed and $H_2O$, $O_2$ and other substances that have been adsorbed by the vacuum chamber and the substrate can be effectively removed to consequently stabilize the device current If and the emission current Ie.

The performance of a surface conduction electron-emitting device prepared by way of the above processes will be described below.

Figure 7A:
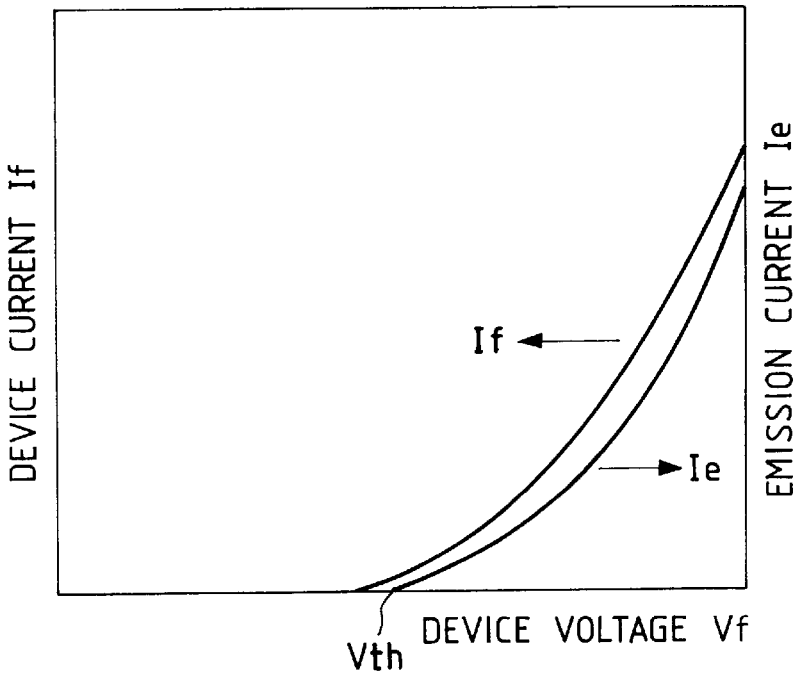
FIGS. 7A and 7B are graphs schematically illustrating the electron-emitting performance of a surface conduction electron-emitting device according to the invention.

FIG. 7A shows a graph schematically illustrating the relationship between the device voltage Vf and the emission current Ie and the device current If typically observed by the gauging system of FIG. 6. Note that different units are arbitrarily selected for Ie and If in FIG. 7A in view of the fact that Ie has a magnitude by far smaller than that of If. Note that both the vertical and transversal axes of the graph represent a linear scale.

As seen in FIG. 7A, an electron-emitting device according to the invention has three remarkable features in terms of emission current Ie, which will be described below.

(i) Firstly, an electron-emitting device according to the invention shows a sudden and sharp increase in the emission current Ie when the voltage applied thereto exceeds a certain level (which is referred to as a threshold voltage hereinafter and indicated by Vth in FIG. 7A), whereas the emission current Ie is practically undetectable when the applied voltage is found lower than the threshold value Vth. Differently stated, an electron-emitting device according to the invention is a non-linear device having a clear threshold voltage Vth to the emission current Ie.

(ii) Secondly, since the emission current Ie is monotonically dependent on the device voltage Vf, the former can be effectively controlled by way of the latter.

(iii) Thirdly, the emitted electric charge captured by the anode 25 is a function of the duration of time of application of the device voltage Vf. In other words, the amount of electric charge captured by the anode 25 can be effectively controlled by way of the time during which the device voltage Vf is applied.

Because of the above remarkable features, it will be understood that the electron-emitting behavior of an electron-emitting device according to the invention can easily be controlled in response to the input signal. Thus, an electron source and an image-forming apparatus comprising a plurality of such devices may find a variety of applications.

Figure 7B:
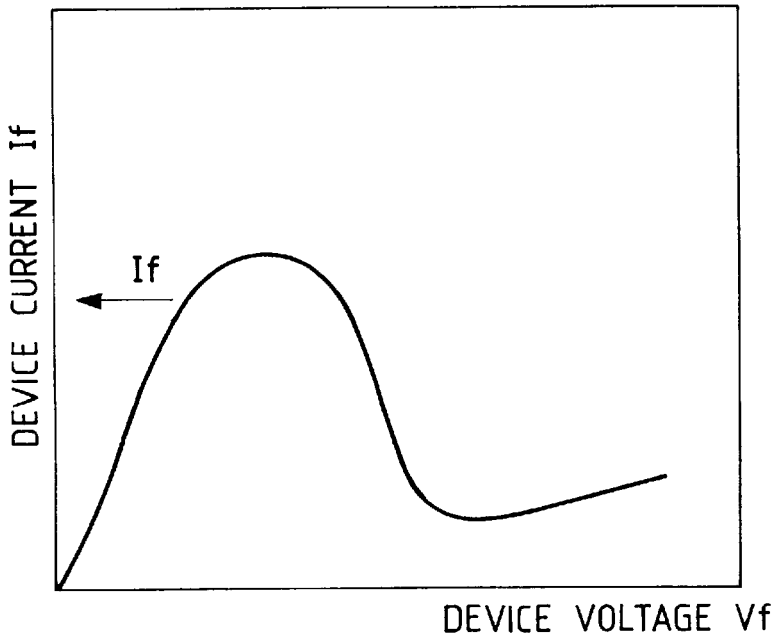

On the other hand, the device current If either monotonically increases relative to the device voltage Vf (as shown by a solid line in FIG. 7A, a characteristic referred to as "MI characteristic" hereinafter) or changes to show a curve (not shown) specific to a voltage-controlled-negative-resistance characteristic (a characteristic referred to as "VCNR characteristic" hereinafter) as shown in FIG. 7B. These characteristics of the device current are dependent on a number of factors including the manufacturing method, the conditions where it is gauged and the environment for operating the device.

Now, some examples of the usage of electron-emitting devices, to which the present invention is applicable, will be described.

According to a second aspect of the invention, an electron source and hence an image-forming apparatus can be realized by arranging a plurality of electron-emitting devices according to the above described first aspect of the present invention together with an image-forming member within a vacuum container.

Electron-emitting devices may be arranged on a substrate in a number of different modes.

For instance, a number of electron-emitting devices may be arranged in rows along a direction (hereinafter referred to row-direction), each device being connected in parallel by wires at opposite ends thereof, and driven to operate by control electrodes (hereinafter referred to as grids) arranged in a space above the electron-emitting devices along a direction perpendicular to the row direction (hereinafter referred to as column-direction) to realize a ladder-like arrangement. Alternatively, a plurality of electron-emitting devices may be arranged in rows along an X-direction and columns along an Y-direction to form a matrix, and the electron-emitting devices on a same row are connected to a common X-directional wire by way of one of the electrodes of each device while the electron-emitting devices on a same column are connected to a common Y-directional wire by way of the other electrode of each device. The latter arrangement is referred to as a simple matrix arrangement. Now, the simple matrix arrangement will be described in detail.

In view of the above described three basic characteristic features (i) through (iii) of a surface conduction electron-emitting device, to which the invention is applicable, it can be controlled for electron emission by controlling the wave height and the wave width of the pulse voltage applied to the opposite electrodes of the device above the threshold voltage level. On the other hand, the device does not practically emit any electron below the threshold voltage level. Therefore, regardless of the number of electron-emitting devices arranged in an apparatus, desired surface conduction electron-emitting devices can be selected and controlled for electron emission in response to an input signal by applying a pulse voltage to each of the selected devices.

Figure 8:
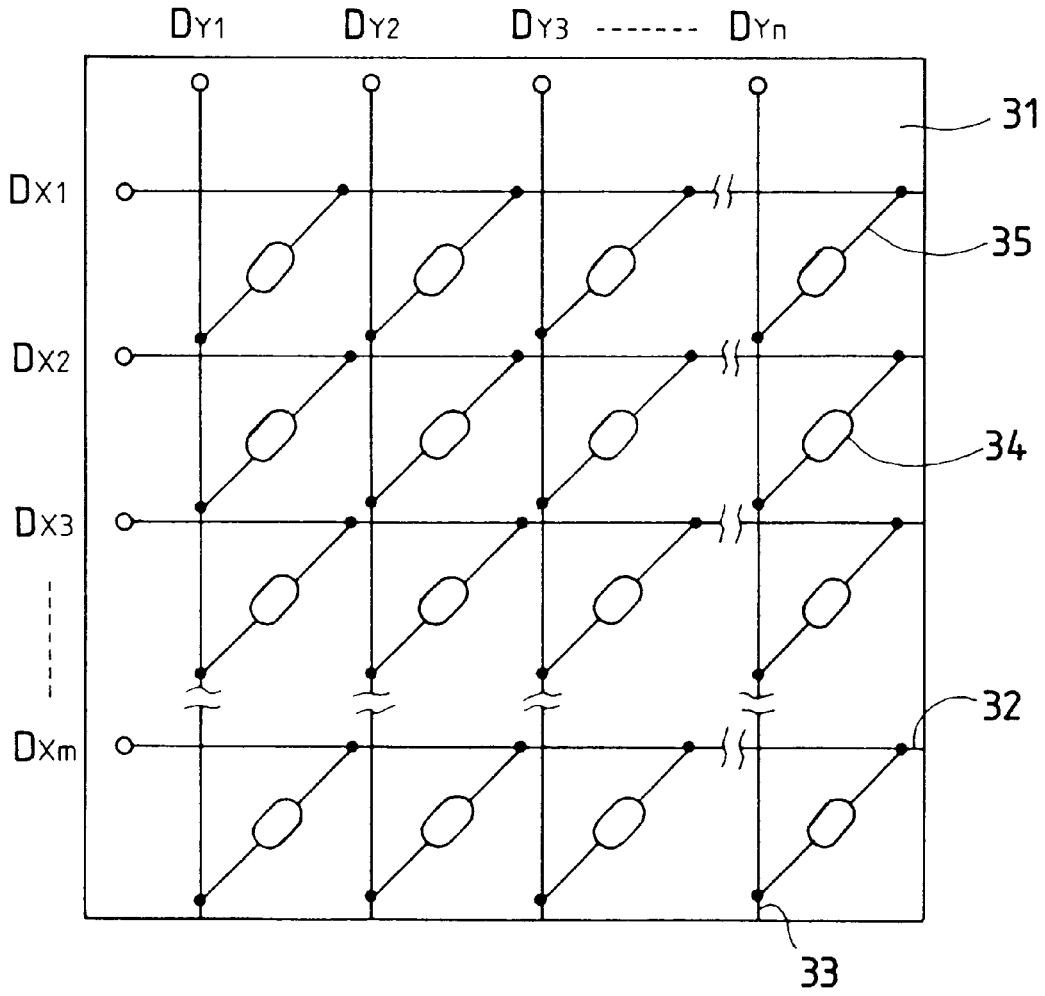
FIG. 8 is a schematic plan view of an electron source having a matrix wiring arrangement.

FIG. 8 is a schematic plan view of the substrate of an electron source realized by arranging a plurality of electron-emitting devices, to which the present invention is applicable, in order to exploit the above characteristic features. In FIG. 8, the electron source comprises a substrate 31, X-directional wires 32, Y-directional wires 33, surface conduction electron-emitting devices 34 and connecting wires 35.

There are provided a total of m X-directional wires 32, which are donated by Dx1, Dx2, . . . , Dx*m* and made of an electroconductive metal produced by vacuum evaporation, printing, sputtering, etc. These wires are so designed as appropriate in terms of material, thickness and width. A total of n Y-directional wires 33 are arranged and donated by Dy1, Dy2, . . . , Dy*n*, similarly to the X-directional wires 32. An interlayer insulation layer (not shown) is disposed between the m X-directional wires 32 and the n Y-directional wires 33 to electrically isolate them from each other. (Both m and n are integers.)

The interlayer insulation layer (not shown) is typically made of $SiO_2$ by means of vacuum evaporation, printing or sputtering. For example, it may be formed on the entire surface or part of the surface of the substrate 31 on which the X-directional wires 32 have been formed. The thickness, material and manufacturing method of the interlayer insulation layer are so selected as to make it withstand the potential difference between any of the X-directional wires 32 and any of the Y-directional wire 33 observable at the crossing thereof. Each of the X-directional wires 32 and the Y-directional wires 33 is drawn out to form an external terminal.

The oppositely arranged paired electrodes (not shown) of each of the surface conduction electron-emitting devices 34 are connected to related one of the m X-directional wires 32 and related one of the n Y-directional wires 33 by respective connecting wires 35 which are made of an electroconductive metal.

The electroconductive metal material of the device electrodes and that of the connecting wires 35 extending from the wire 32 and 33 may be same or contain a common element as an ingredient. Alternatively, they may be different from each other. These materials may be appropriately selected typically from the candidate materials listed above for the device electrodes. If the device electrodes and the connecting wires are made of a same material, they may be collectively called device electrodes without discriminating the connecting wires.

The X-directional wires 32 are electrically connected to a scan signal application means (not shown) for applying a scan signal to a selected row of surface conduction electron-emitting devices 34. On the other hand, the Y-directional wires 33 are electrically connected to a modulation signal generation means (not shown) for applying a modulation signal to a selected column of surface conduction electron-emitting devices 34 and modulating the selected column according to an input signal. Note that the drive signal to be applied to each surface conduction electron-emitting device is expressed as the voltage difference of the scan signal and the modulation signal applied to the device.

With the above arrangement, each of the devices can be selected and driven to operate independently by means of a simple matrix wire arrangement.

Figure 9:
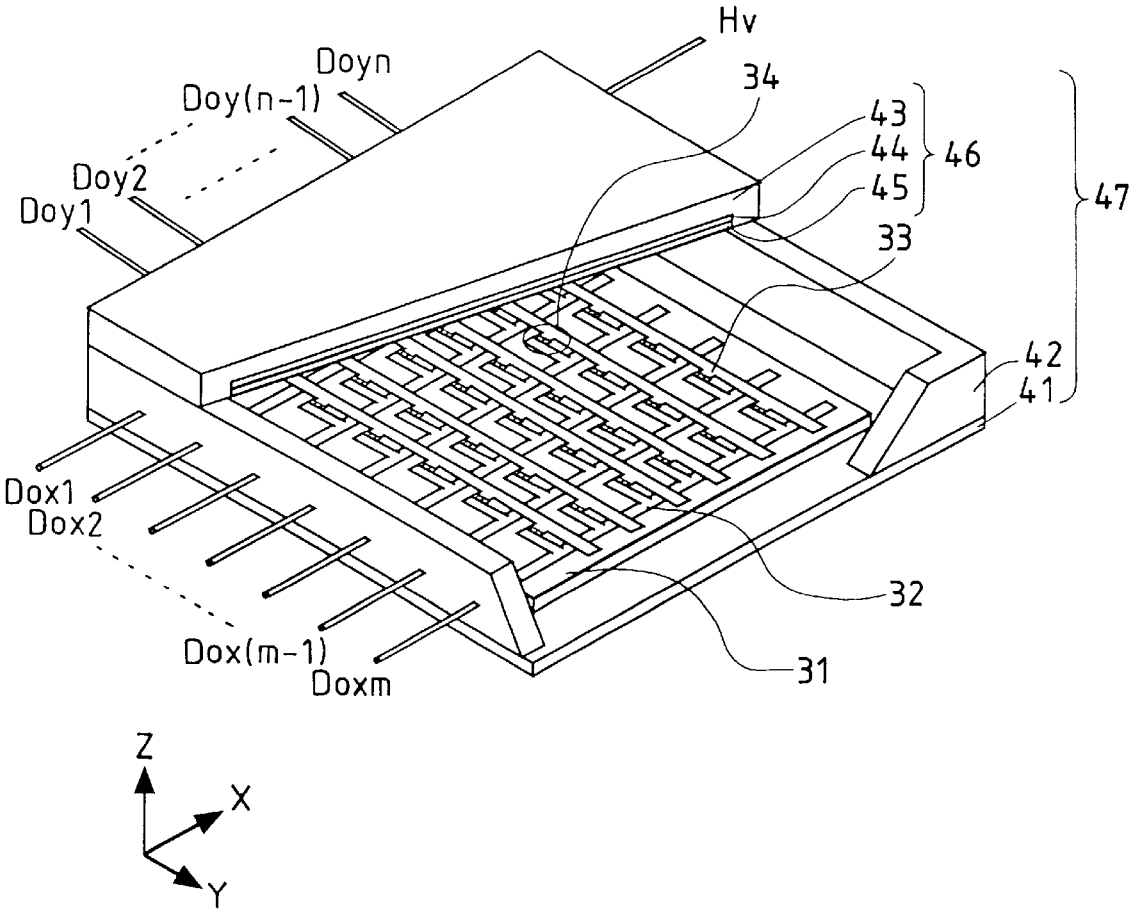
FIG. 9 is a schematic perspective view of an image-forming apparatus comprising an electron source having a matrix wiring arrangement.
Figure 10A:
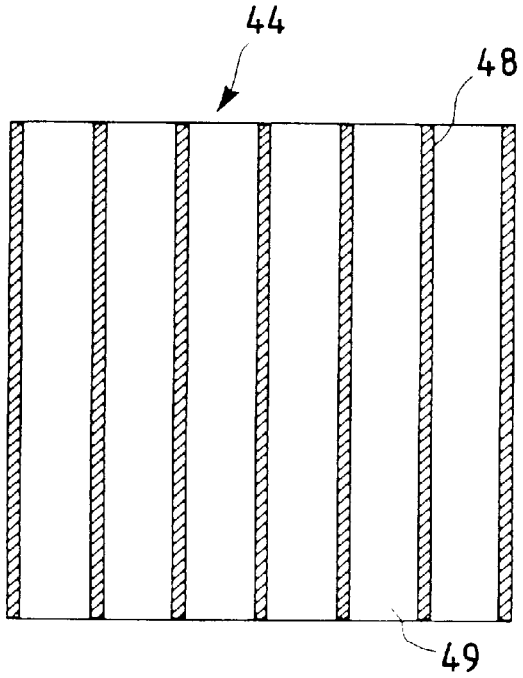
FIGS. 10A and 10B are two possible arrangements of fluorescent members that can be used for the purpose of the invention.
Figure 10B:
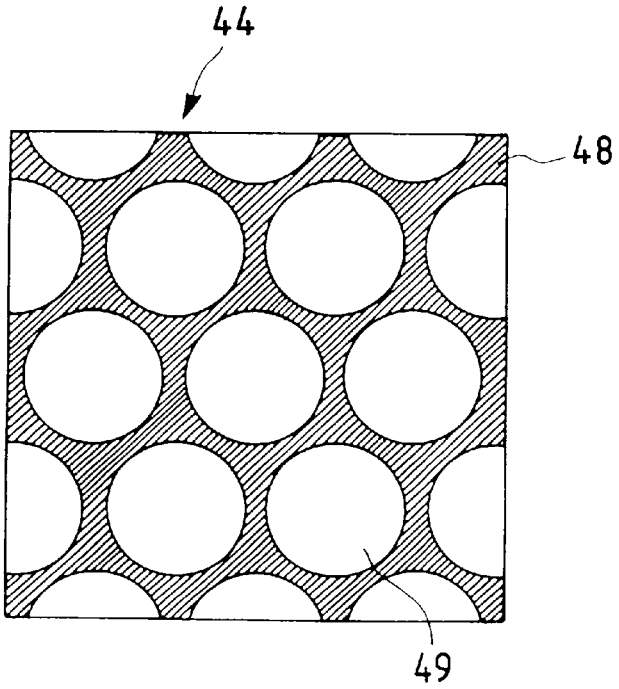
Figure 11:
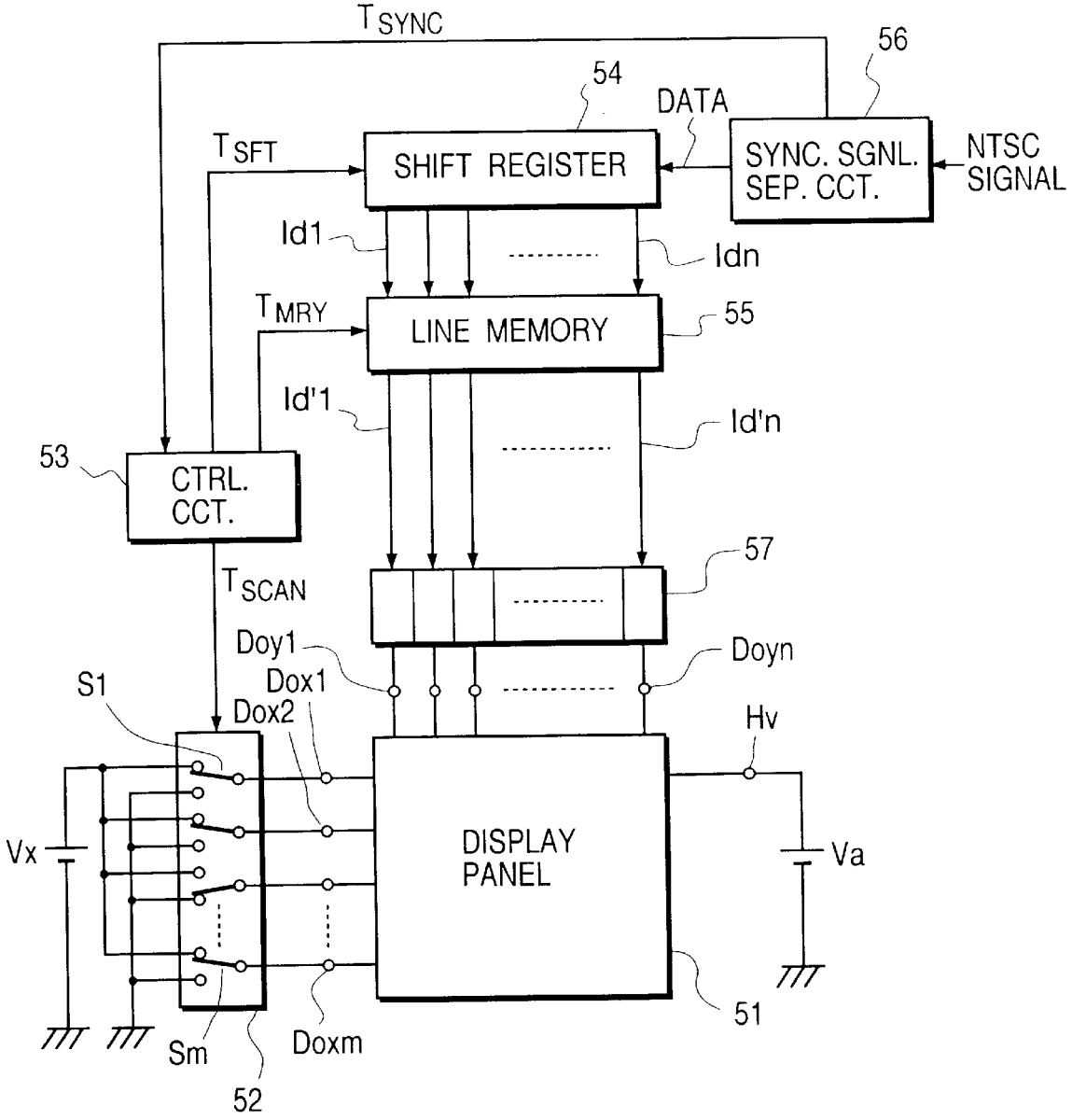
FIG. 11 is a schematic circuit diagram of a drive circuit that can be used for displaying images according to NTSC television signals as well as a block diagram of an image-forming apparatus comprising an electron source having a matrix wiring arrangement that can be driven by such a drive circuit.

Now, an image-forming apparatus comprising an electron source having a simple matrix arrangement as described above will be described by referring to FIGS. 9, 10A, 10B and 11. FIG. 9 is a partially cut away schematic perspective view of the image forming apparatus and FIGS. 10A and 10B are schematic views, illustrating two possible configurations of a fluorescent film that can be used for the image forming apparatus of FIG. 9, whereas FIG. 11 is a block diagram of a drive circuit for the image forming apparatus of FIG. 9 that operates for NTSC television signals.

Referring firstly to FIG. 9 illustrating the basic configuration of the display panel of the image-forming apparatus, it comprises an electron source substrate 31 of the above described type carrying thereon a plurality of electron-emitting devices, a rear plate 41 rigidly holding the electron source substrate 31, a face plate 46 prepared by laying a fluorescent film 44 and a metal back 45 on the inner surface of a glass substrate 43 and a support frame 42, to which the rear plate 41 and the face plate 46 are bonded by means of frit glass. Reference numeral 47 denote an envelope, which is baked to 400 to 500° C. for more than 10 minutes in the atmosphere or in nitrogen and hermetically and airtightly sealed.

In FIG. 9, reference numeral 34 denotes the electron-emitting devices and reference numerals 32 and 33 respectively denotes the X-directional wire and the Y-directional wire connected to the respective device electrodes of each electron-emitting device.

While the envelope 47 is formed of the face plate 46, the support frame 42 and the rear plate 41 in the above described embodiment, the rear plate 41 may be omitted if the substrate 31 is strong enough by itself because the rear plate 41 is provided mainly for reinforcing the substrate 31. If such is the case, an independent rear plate 41 may not be required and the substrate 31 may be directly bonded to the support frame 42 so that the envelope 47 is constituted of a face plate 46, a support frame 42 and a substrate 31. The overall strength of the envelope 47 may be increased by arranging a number of support members called spacers (not shown) between the face plate 46 and the rear plate 41.

FIGS. 10A and 10B schematically illustrate two possible arrangements of fluorescent film. While the fluorescent film 44 comprises only a single fluorescent body if the display panel is used for showing black and white pictures, it needs to comprise for displaying color pictures black conductive members 48 and fluorescent bodies 49, of which the former are referred to as black stripes or members of a black matrix depending on the arrangement of the fluorescent bodies. Black stripes or members of a black matrix are arranged for a color display panel so that the fluorescent bodies 49 of three different primary colors are made less discriminable and the adverse effect of reducing the contrast of displayed images of external light is weakened by blackening the surrounding areas. While graphite is normally used as a principal ingredient of the black stripes, other conductive material having low light transmissivity and reflectivity may alternatively be used.

A precipitation or printing technique is suitably be used for applying a fluorescent material on the glass substrate regardless of black and white or color display. An ordinary metal back 45 is arranged on the inner surface of the fluorescent film 44. The metal back 45 is provided in order to enhance the luminance of the display panel by causing the rays of light emitted from the fluorescent bodies and directed to the inside of the envelope to turn back toward the face plate 46, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and forming an Al film thereon by vacuum evaporation after forming the fluorescent film.

A transparent electrode (not shown) may be formed on the face plate 46 facing the outer surface of the fluorescent film 44 in order to raise the conductivity of the fluorescent film 44.

Care should be taken to accurately align each set of color fluorescent bodies and an electron-emitting device, if a color display is involved, before the above listed components of the envelope are bonded together.

Now, a method of manufacturing an image-forming apparatus as illustrated in FIG. 9 will be described below.

Figure 12:
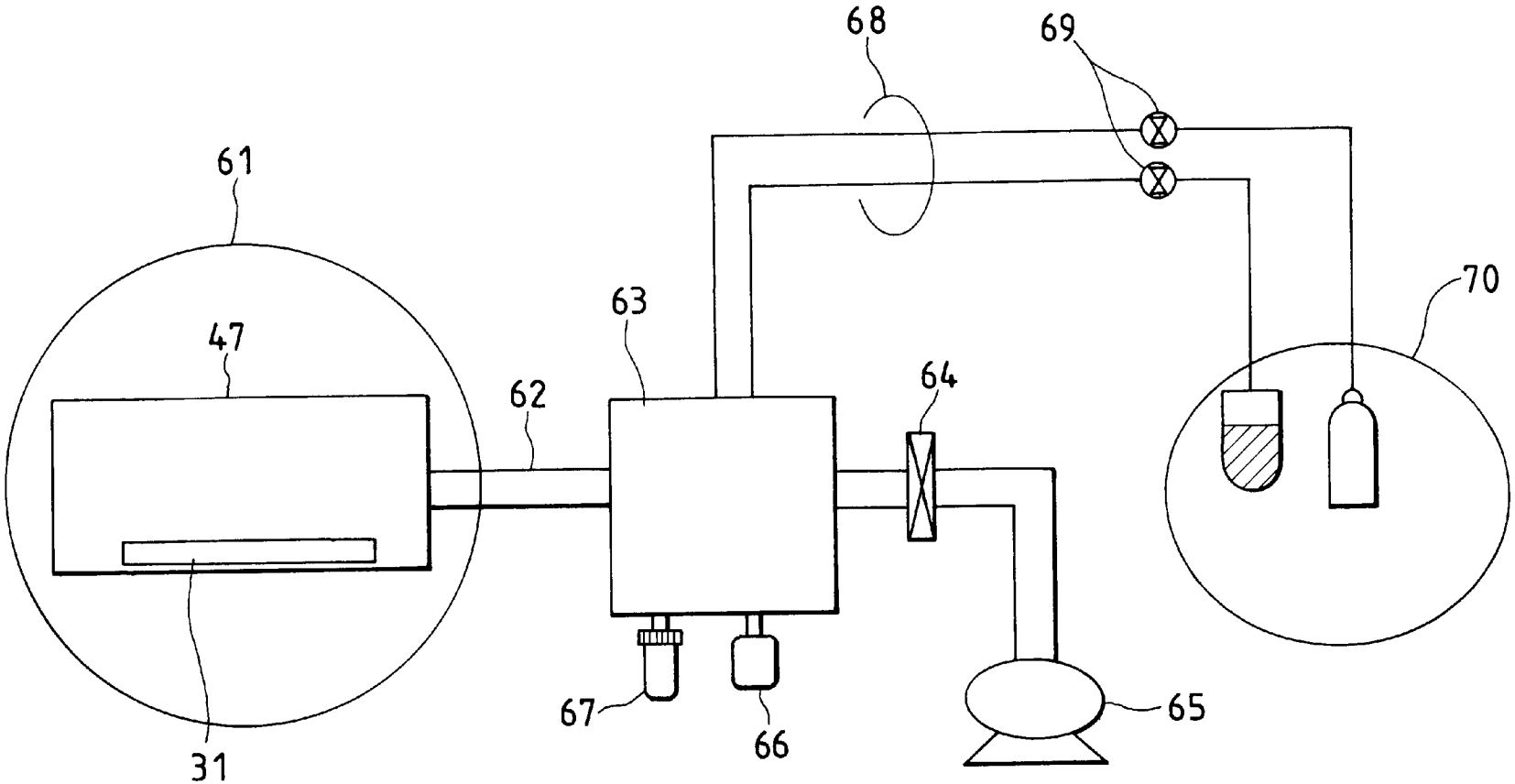
FIG. 12 is a schematic block diagram of a vacuum processing system that can be used for manufacturing an image-forming apparatus according to the invention.

FIG. 12 shows a schematic block diagram of a vacuum processing system that can be used for manufacturing an image-forming apparatus according to the invention.

In FIG. 12, an image-forming apparatus 61 is connected to the vacuum chamber 63 of the vacuum system by way of an exhaust pipe 62. The image-forming apparatus 61 is further connected to a vacuum pump unit 65 by way of a gate valve 64. A pressure gauge 66, a quadrupole mass (Q-mass) spectrometer 67 and other instruments are arranged within the vacuum chamber 63 to measure the internal pressure and the partial pressures of the gases within the chamber. Since it is difficult to directly gauge the internal pressure of the envelope 47 of the image-forming apparatus 61, the parameters for the manufacturing operation are controlled by gauging the internal pressure of the vacuum chamber 63 and other measurable factors.

A gas feed line 68 is connected to the vacuum chamber 63 in order to introduce a gaseous substance necessary for the operation and control the atmosphere within the chamber. The gas feed line 68 is, at the other end, connected to a substance source 70, that may be an ampule or a cylinder containing a substance to be supplied to the vacuum chamber. A feeding rate control means 69 is arranged on the gas feed line in order to control the rate at which the substance in the source 70 is fed to the chamber. More specifically, the feeding rate control means may be a slow leak valve that can control the rate of leaking gas or a mass flow controller depending on the type of the substance to be fed.

Figure 15:
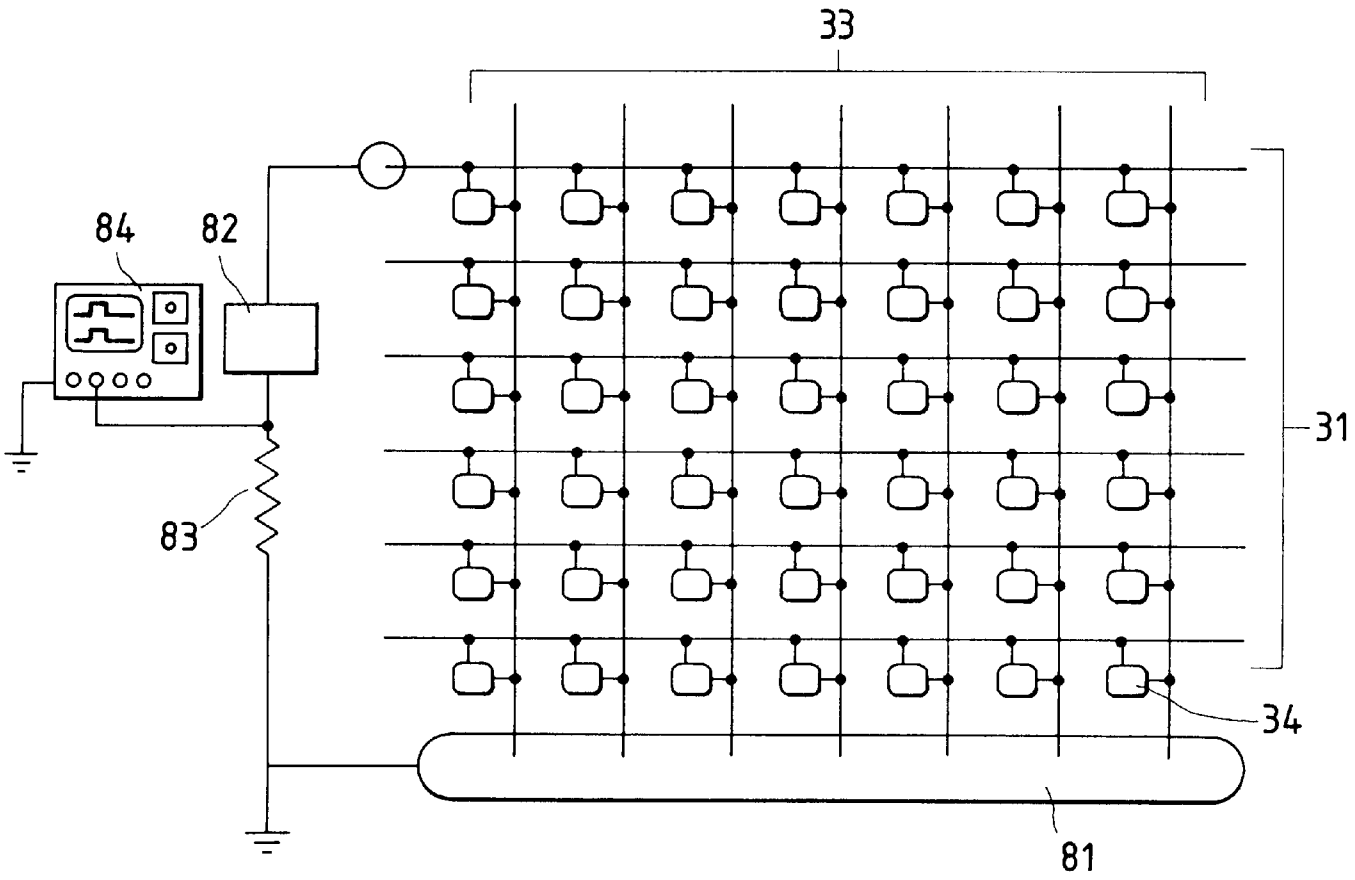
FIG. 15 is a schematic circuit diagram that can be used for carrying out an energization forming process on an electron source.

After evacuating the inside of the envelope 47, the image forming apparatus is subjected to a forming process. This process may be carried out (as shown in FIG. 15) by connecting the Y-directional wires 33 to common electrode 81 and applying a pulse voltage to the electron-emitting devices connected to each of the X-directional wires 32 on a wire by wire basis. The wave form of the pulse voltage to be applied, the conditions under which the process is terminated are other factors concerning the process may be appropriately selected by referring to the above description on the forming process for a single electron-emitting device. The devices connected to the plurality of X-directional wires may be collectively subjected to a forming process by sequentially applying (scrolling) a pulse voltage with a shifting phase. In FIG. 15, reference numeral 83 denotes a resistor for gauging an electric current running therethrough and reference numeral 84 denotes an oscilloscope for gauging an electric current.

After the completion of the forming process, the image-forming apparatus is subjected to a subsequent process, where films for providing an additional resistance are formed and the devices are activated.

In this process, a source gas selected appropriately depending on the material of the layers to be formed within the envelope is introduced and a pulse voltage is applied to each electron-emitting device to produce a film of a semiconductor substance, a metal oxide, carbon, a carbon compound or a metal on the device by deposition. The wiring arrangement to be used for this process may be same as the one described above for a forming process. In other words, a pulse voltage may be applied in a scrolling fashion.

The envelope 47 is evacuated by means of the vacuum pump unit 65 such as an ion pump or a sorption pump that does not involve the use of oil by way of the exhaust pipe 62, while it is being heated to 80 to 250° C., until the atmosphere in the inside is reduced to a sufficient degree of vacuum and the organic substances contained therein and the substances introduced in the foregoing step are satisfactorily eliminated, when the exhaust pipe is heated to melt by a burner and then hermetically sealed. Then, a getter process may be conducted in order to maintain the achieved degree of vacuum in the inside of the envelope 47 after it is sealed. In a getter process, a getter (not shown) arranged at a predetermined position in the envelope 47 is heated by means of a resistance heater or a high frequency heater to form a film by evaporation immediately before or after the envelope 47 is sealed. A getter typically contains Ba as a principal ingredient and can maintain a degree of vacuum within the envelope 47 by the adsorption effect of the film deposited by evaporation.

Now, a drive circuits for driving a display panel comprising an electron source with a simple matrix arrangement for displaying television images according to NTSC television signals will be described by referring to FIG. 11. In FIG. 11, reference numeral 51 denotes a display panel. Otherwise, the circuit comprises a scan circuit 52, a control circuit 53, a shift register 54, a line memory 55, a synchronizing signal separation circuit 56 and a modulation signal generator 57. Vx and Va in FIG. 11 denote DC voltage sources.

The display panel 51 is connected to external circuits via terminals Dox1 through Dox*m*, Doy1 through Doy*m* and high voltage terminal Hv, of which terminals Dox1 through Dox*m* are designed to receive scan signals for sequentially driving on a one-by-one basis the rows (of N devices) of an electron source in the apparatus comprising a number of surface-conduction type electron-emitting devices arranged in the form of a matrix having M rows and N columns.

On the other hand, terminals Doy1 through Doyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 kV, which is sufficiently high to energize the fluorescent bodies of the selected surface-conduction type electron-emitting devices.

The scan circuit 52 operates in a manner as follows. The circuit comprises M switching devices (of which only devices S1 and S*m* are specifically indicated in FIG. 13), each of which takes either the output voltage of the DC voltage source Vx or 0[V] (the ground potential level) and comes to be connected with one of the terminals Dox1 through Dox*m* of the display panel 51. Each of the switching devices S1 through S*m* operates in accordance with control signal Tscan fed from the control circuit 53 and can be prepared by combining switching devices such as FETs.

The DC voltage source Vx of this circuit is designed to output a constant voltage such that any drive voltage applied to devices that are not being scanned is reduced to less than threshold voltage due to the performance of the surface conduction electron-emitting devices (or the threshold voltage for electron emission).

The control circuit 53 coordinates the operations of related components so that images may be appropriately displayed in accordance with externally fed video signals. It generates control signals Tscan, Tsft and Tmry in response to synchronizing signal Tsync fed from the synchronizing signal separation circuit 56, which will be described below.

The synchronizing signal separation circuit 56 separates the synchronizing signal component and the luminance signal component from an externally fed NTSC television signal and can be easily realized using a popularly known frequency separation (filter) circuit. Although a synchronizing signal extracted from a television signal by the synchronizing signal separation circuit 56 is constituted, as well known, of a vertical synchronizing signal and a horizontal synchronizing signal, it is simply designated as Tsync signal here for convenience sake, disregarding its component sgnals. On the other hand, a luminance signal drawn from a television signal, which is fed to the shift register 54, is designated as DATA signal.

The shift register 54 carries out for each line a serial/parallel conversion on DATA signals that are serially fed on a time series basis in accordance with control signal Tsft fed from the control circuit 53. (In other words, a control signal Tsft operates as a shift clock for the shift register 54.) A set of data for a line of one image that have undergone a serial/parallel conversion (and correspond to a set of drive data for N electron-emitting devices) are sent out of the shift register 54 as n parallel signals Id1 through Id*n*.

The line memory 55 is a memory for storing a set of data for a line of one image, which are signals Id1 through Id*n*, for a required period of time according to control signal Tmry coming from the control circuit 53. The stored data are sent out as Id'1 through Id'*n* and fed to the modulation signal generator 57.

Said modulation signal generator 57 is in fact a signal source that appropriately drives and modulates the operation of each of the surface-conduction type electron-emitting devices and output signals of this device are fed to the surface-conduction type electron-emitting devices in the display panel 51 via terminals Doy1 through Doy*n*.

As described above, an electron-emitting device, to which the present invention is applicable, is characterized by the following features in terms of emission current Ie. Firstly, there exists a clear threshold voltage Vth and the device emits electrons only when a voltage exceeding Vth is applied thereto. Secondly, the level of emission current Ie changes as a function of the change in the applied voltage above the threshold level Vth. More specifically, when a pulse-shaped voltage is applied to an electron-emitting device according to the invention, practically no emission current is generated so far as the applied voltage remains under the threshold level, whereas an electron beam is emitted once the applied voltage rises above the threshold level. It should be noted here that the intensity of an output electron beam can be controlled by changing the peak level Vm of the pulse-shaped voltage. Additionally, the total amount of electric charge of an electron beam can be controlled by varying the pulse width Pw.

Thus, either voltage modulation method or pulse width modulation method may be used for modulating an electron-emitting device in response to an input signal. With voltage modulation, a voltage modulation type circuit is used for the modulation signal generator 57 so that the peak level of the pulse shaped voltage is modulated according to input data, while the pulse width is held constant.

With pulse width modulation, on the other hand, a pulse width modulation type circuit is used for the modulation signal generator 57 so that the pulse width of the applied voltage may be modulated according to input data, while the peak level of the applied voltage is held constant.

Although it is not particularly mentioned above, the shift register 54 and the line memory 55 may be either of digital or of analog signal type so long as serial/parallel conversions and storage of video signals are conducted at a given rate.

If digital signal type devices are used, output signal DATA of the synchronizing signal separation circuit 56 needs to be digitized. However, such conversion can be easily carried out by arranging an A/D converter at the output of the synchronizing signal separation circuit 56. It may be needless to say that different circuits may be used for the modulation signal generator 57 depending on if output signals of the line memory 55 are digital signals or analog signals. If digital signals are used, a D/A converter circuit of a known type may be used for the modulation signal generator 57 and an amplifier circuit may additionally be used, if necessary. As for pulse width modulation, the modulation signal generator 57 can be realized by using a circuit that combines a high speed oscillator, a counter for counting the number of waves generated by said oscillator and a comparator for comparing the output of the counter and that of the memory. If necessary, am amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 57 and a level shift circuit may be added thereto if necessary. As for pulse width modulation, a known voltage control type oscillation circuit (VCO) may be used with, if necessary, an additional amplifier to be used for voltage amplification up to the drive voltage of a surface-conduction type electron-emitting device.

With an image forming apparatus having a configuration as described above, to which the present invention is applicable, the electron-emitting devices emit electrons as a voltage is applied thereto by way of the external terminals Dox1 through Dox*m* and Doy1 through Doy*n*. Then, the generated electron beams are accelerated by applying a high voltage to the metal back 45 or a transparent electrode (not shown) by way of the high voltage terminal Hv. The accelerated electrons eventually collide with the fluorescent film 44, which by turn glows to produce images.

The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is also suited for TV signals involving a larger number of scanning lines (typically of a high definition TV system such as the MUSE system).

Now, an electron source comprising a plurality of electron-emitting devices arranged in a ladder-like manner on a substrate and an image-forming apparatus comprising such an electron source will be described by referring to FIGS. 13 and 14.

Figure 13:
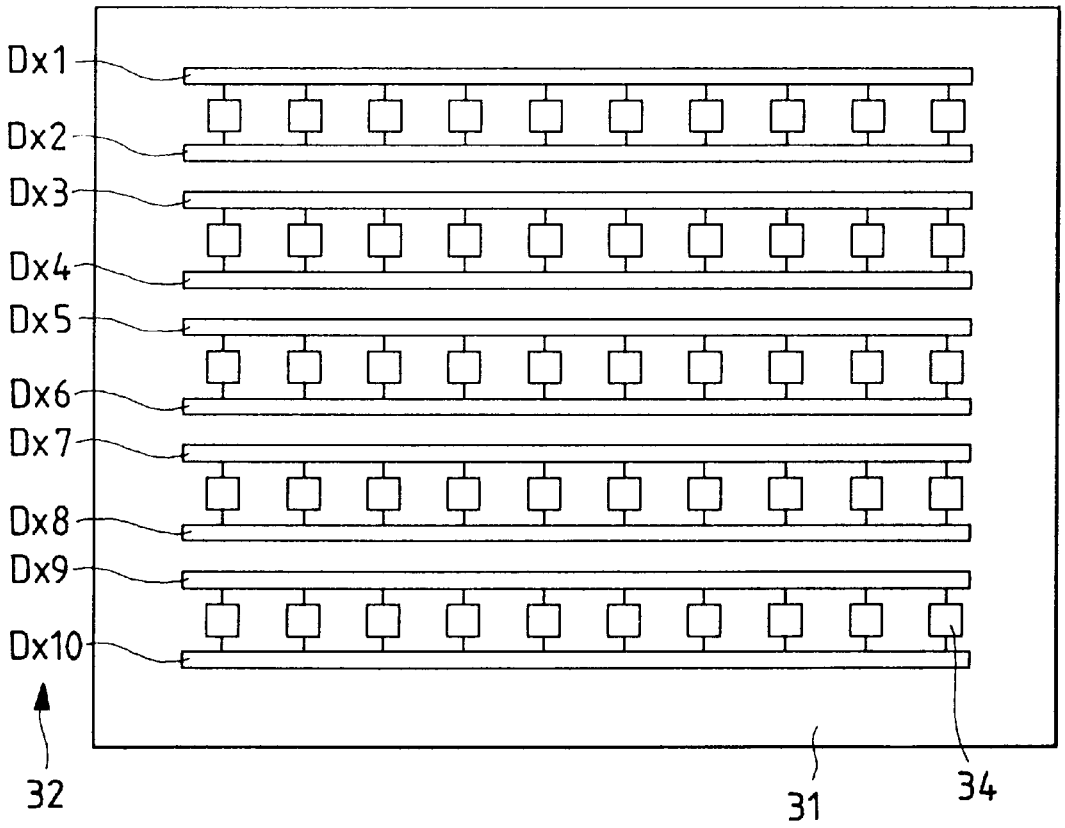
FIG. 13 is a schematic plan view of an electron source having a ladder-like wiring arrangement.

Firstly referring to FIG. 13 schematically showing an electron source having a ladder-like arrangement, reference numeral 31 denotes an electron source substrate and reference numeral 34 denotes an electron-emitting device arranged on the substrate, whereas reference numeral 32 denotes (X-directional) wires Dx1 through Dx10 for connecting the surface conduction electron-emitting devices 34. The electron-emitting devices 34 are arranged in rows (to be referred to as device rows hereinafter) on the substrate 31 to form an electron source comprising a plurality of device rows, each row having a plurality of devices. The surface conduction electron-emitting devices of each device row are electrically connected in parallel with each other by a pair of common wires so that they can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wire. Thus, for example, of the common wires Dx2 through Dx9, Dx2 and Dx3 can share a single common wire instead of two wires.

Figure 14:
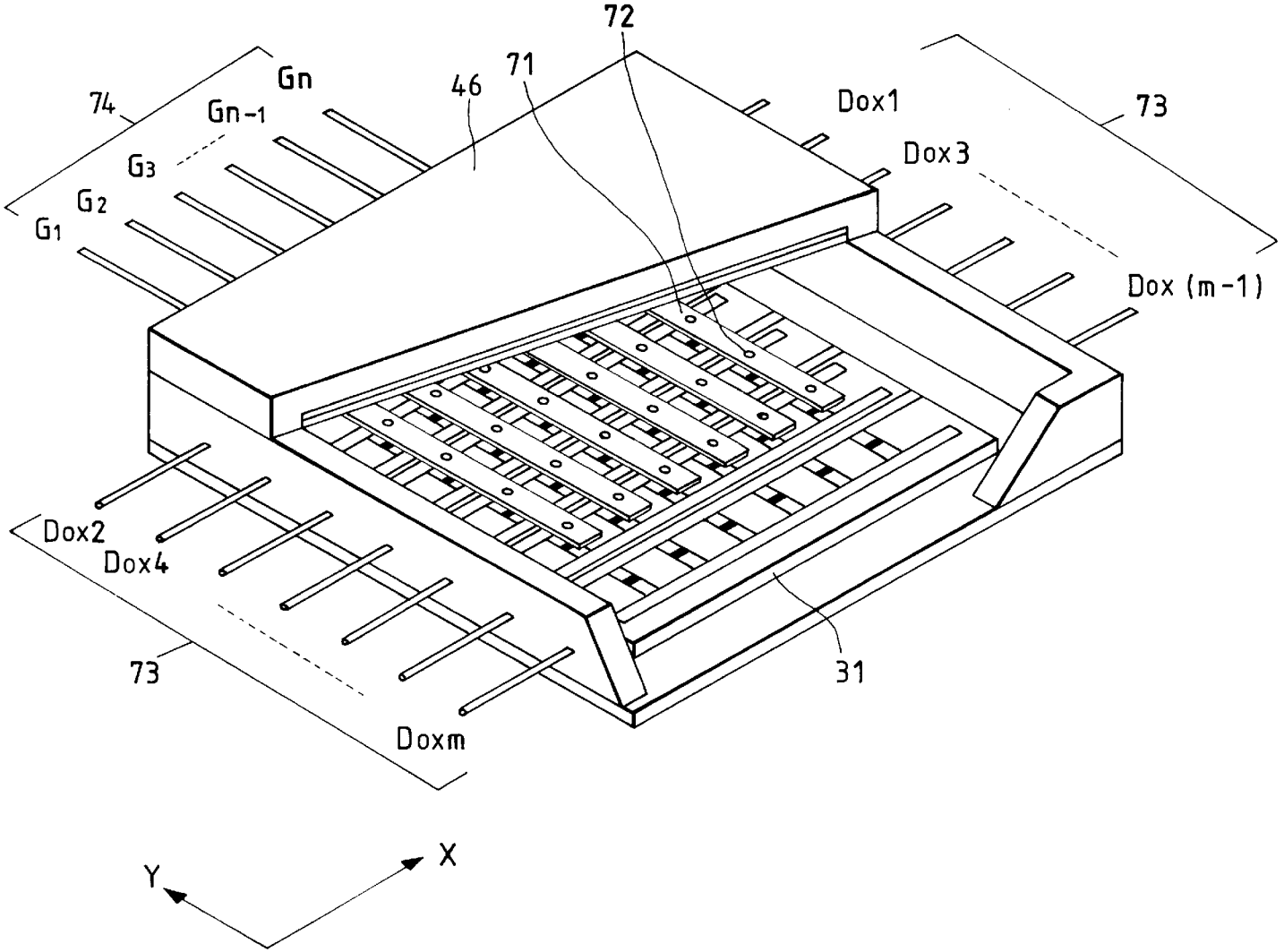
FIG. 14 is a schematic perspective view of an image-forming apparatus comprising an electron source having a ladder-like wiring arrangement.

FIG. 14 is a schematic perspective view of the display panel of an image-forming apparatus incorporating an electron source having a ladder-like arrangement of electron-emitting devices. In FIG. 14, the display panel comprises grid electrodes 71, each provided with a number of bores 72 for allowing electrons to pass therethrough and a set of external terminals 73, or Dox1, Dox2, . . . , Dox*m*, along with another set of external terminals 74, or G1, G2, . . . , G*n*, connected to the respective grid electrodes 71 and an electron source substrate 31. The image forming apparatus differs from the image forming apparatus with a simple matrix arrangement of FIG. 9 mainly in that the apparatus of FIG. 14 has grid electrodes 71 arranged between the electron source substrate 31 and the face plate 46.

In FIG. 14, the stripe-shaped grid electrodes 71 are arranged between the substrate 31 and the face plate 46 perpendicularly relative to the ladder-like device rows for modulating electron beams emitted from the surface conduction electron-emitting devices, each provided with through bores 72 in correspondence to respective electron-emitting devices for allowing electron beams to pass therethrough. Note that, however, while stripe-shaped grid electrodes are shown in FIG. 14, the profile and the locations of the electrodes are not limited thereto. For example, they may alternatively be provided with mesh-like openings and arranged around or close to the surface conduction electron-emitting devices.

The external terminals 73 and the external terminals 74 for the grids are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

Now, the present invention will be described by way of examples.

EXAMPLES 1–6, COMPARATIVE EXAMPLES 1–4

FIGS. 2A and 2B schematically illustrate electron-emitting devices prepared in these examples. The process employed for manufacturing each of the electron-emitting devices will be described by referring to FIGS. 4A through 4C.

Step-a:

After thoroughly cleansing a soda lime glass plate, a silicon oxide film was formed thereon to a thickness of 0.5 $\mu$m by sputtering to produce a substrate 1, on which a pattern of photoresist (RD-2000N-41: available from Hitachi Chemical Co., Ltd.) having openings corresponding to the pattern of a pair of electrodes was formed. Then, a Ti film and an Ni film were sequentially formed to respective thicknesses of 5 nm and 100 nm by vacuum evaporation. Thereafter, the photoresist was dissolved by an organic solvent and the Ni/Ti film was lifted off to produce a pair of device electrodes 2 and 3. The device electrodes was separated by distance L of 3 $\mu$m and had a width of 300 $\mu$m. (FIG. 4A)

Step-b:

To produce an electroconductive thin film 12, a mask of Cr film was formed on the device to a thickness of 300 nm by vacuum evaporation and then an opening corresponding to the pattern of the electroconductive thin film was formed by photolithography.

Thereafter, a Pd amine complex solution (ccp4230: available from Okuno Pharmaceutical Co., Ltd.) was applied to the Cr film by means of a spinner and baked at 300° C. for 12 minutes in the atmosphere to produce a fine particle film containing PdO as a principal ingredient. The film had a film thickness of 7 nm.

Step-c:

The Cr mask was removed by wet-etching and the PdO fine particle film was lifted off to obtain an electroconductive thin film 12 having a desired profile. The electroconductive thin film showed an electric resistance of $Rs=2\times10^4\ \Omega/\square$. (FIG. 4B)

Step-d:

The above device was placed in a gauging system as illustrated in FIG. 6 and the vacuum chamber 26 of the system was evacuated by means of a vacuum pump unit 27 to a pressure of $2.7\times10^{-3}$ Pa. Subsequently, a pulse voltage was applied between the device electrodes 2 and 3 to carry out an energization forming process and produce an electron emitting region 6 (FIG. 4C). The pulse voltage was a triangular pulse voltage whose peak value gradually increased with time as shown in FIG. 5B. The pulse width of T1=1 msec and the pulse interval of T2=10 msec were used. During the energization forming process, an extra pulse voltage of 0.1 V (not shown) was inserted into intervals of the forming pulse voltage in order to determine the resistance value and the electric forming process was terminated when the resistance exceeded 1 MΩ. The peak value of the pulse voltage (forming voltage) was 5.0 to 5.1 V when the forming process was terminated.

Step-e:

Subsequently, while maintaining the electron-emitting device in the vacuum chamber 26 of the gauging system of FIG. 6, the pressure of the inside of the vacuum chamber 26 was reduced to $1.3\times10^{-7}$ Pa. Thereafter, $SiH_4$ was introduced into the vacuum chamber 26 until the pressure raised to $1.3\times10^{-1}$ Pa. Then, a small amount of $PH_3$ was additionally introduced in order to control the electric resistance of the film to be formed on the device.

A pulse voltage was applied between the device electrodes 2 and 3 by the power source 21 to form an Si film 7 on the border of the electron-emitting region 6 and the lower potential side electroconductive thin film 4. A triangular pulse as illustrated in FIG. 5A having a pulse width of T1=100 μsec and a pulse interval of T2=10 msec was used. Note that, in each of these examples and comparative examples, a positive potential pulse was applied to the lower potential side device electrode 2 and the higher potential side device electrode 3 was held to the ground potential, contrary to the case of giving rise to electron emission, so that an Si film was formed on the border of the electron-emitting region 6 and the lower potential side electroconductive thin film 4.

The duration of time of the above operation was determined on the basis of the data obtained as a result of a series of preliminary experiment conducted for the present invention so that a desired additional electric resistance was obtained for each device.

After an Si film was formed, the vacuum chamber 26 was evacuated again and heated to 300° C. by means of a heater (not shown) to stabilize the film.

Step-f:

Acetone was introduced into the vacuum chamber 26 to raise the internal pressure to $1.3\times10^{-1}$ Pa. A pulse voltage was applied between the device electrodes 2 and 3 to form a film 8 of a carbon compound. A triangular pulse as illustrated in FIG. 5A having a wave height of 16 V, a pulse width of T=1 msec. and a pulse interval of T2=10 msec. was used. The polarity of the applied pulse was same as the case of electron emission. The pulse voltage was applied for 30 minutes. Film of a carbon compound was mainly formed on the higher potential side.

Step-g:

Thereafter, a stabilization process was carried out.

In this step, the vacuum chamber 26 was evacuated to lower the internal pressure to less than $1.3\times10^{-6}$ Pa. Then, the device was heated to 250° C. and, because the internal pressure of the vacuum chamber was raised by the heating, then it was further evacuated. After 24 hours of continuous heating, the pressure fell to less than $1.3\times10^{-6}$ Pa and therefore the heating was terminated.

Figure 16:
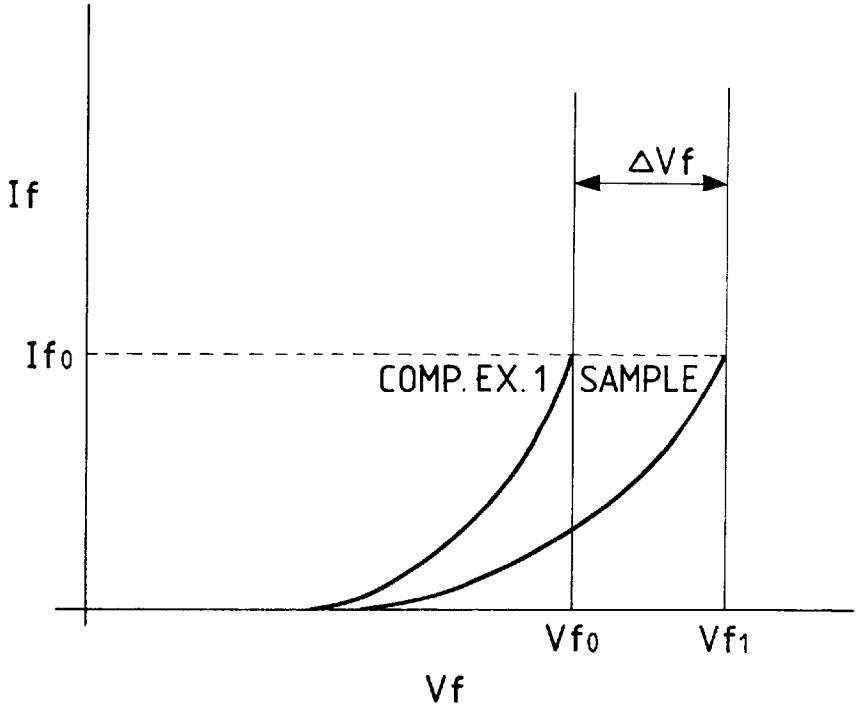
FIG. 16 is a graph showing a technique for determining the additional resistance provided by a resistive film.

The prepared devices of the above examples and comparative examples were then tested for the performance of electron emission. For each device, If was observed prior to Ie and each of the devices of the above examples was compared with the device of Comparative Example 1 for which Step-e had been omitted to determine the additional electric resistance produced by the additional Si film 7. This will be described by referring to FIG. 16.

For each sample device, a triangular pulse voltage was applied to observe the Vf-If relationship of the device. The solid line represents the performance of the device relative to that of the device of Comparative Example 1. The pulse wave height was $Vf_0$=14 V and the corresponding device current If was $If_0$=1.2 mA. Then, a similar triangular pulse voltage was applied to the device being tested and the wave height of the pulse voltage was gradually raised, observing the peak level of the device current If until the peak device current became equal to $If_0$. If the wave height at this time was $Vf_1$, it could be safely assumed that the voltage fall of $\Delta Vf=Vf_1-Vf_0$ was given rise to by the additional resistance. Therefore, the additional electric resistance could be determined by equation $$R_{ad}=\Delta Vf/If_0.$$

Ie was measured by applying a rectangularly parallelepipedic pulse voltage and the average emission current <Ie> and the extent of fluctuations ΔIe were obtained for consecutive 600 pulse waves. The wave height of the applied rectangularly parallelepipedic pulse voltage was made equal to the above obtained $Vf_1$, and a pulse width of T1=100 μsec. and a pulse interval of T2=10 msec. were used. The distance between the device and the anode 25 was H=4 mm and the potential difference between the device and the anode was made equal to Va=1 kV.

For all the devices of the above examples and comparative examples, <Ie> was 1.1 μA. The readings of $R_{ad}$, and (ΔIe/<Ie>) and (ΔIf/<If>) for the devices are shown below.

TABLE 1

| Device | $R_{ad}$ (Ω) | ΔIe/<Ie> (%) | ΔIf/<If> (%) |
|---|---|---|---|
| Comparative Example 1 | 0 | 10.5 | 11.2 |
| Comparative Example 2 | 83 | 9.5 | 9.9 |
| Comparative Example 3 | 167 | 8.5 | 8.7 |
| Comparative Example 4 | 333 | 8.0 | 7.8 |
| Example 1 | 500 | 7.0 | 7.2 |
| Example 2 | 667 | 6.2 | 6.0 |
| Example 3 | 1000 | 5.1 | 5.2 |
| Example 4 | 2000 | 3.5 | 3.5 |
| Example 5 | 3000 | 2.5 | 2.2 |
| Example 6 | 5000 | 1.8 | 1.8 |
| Example 7 | 10000 | 1.0 | 1.2 |

EXAMPLE 8

In this example, Step-e and Step-f of Example 3 were reversed to produce a surface conduction electron-emitting device, which showed an exactly same performance of the device of Example 3.

EXAMPLE 9

Steps-a through d of Examples 1 through 7 were followed for this example. Subsequently, Step-e:

Dimethylaluminum hydride was introduced into the vacuum chamber 26, using oxygen as a carrier gas, until the internal pressure was raised to $1.3\times10^{-1}$ Pa. A pulse same as those of Step-e of Examples 1 through 6 was applied to the device to produce a film 7 of aluminum oxide.

Step-f:

A film 8 of a carbon compound was formed as in the case of Step-f of Examples 1 through 7.

Step-g:

A stabilizing process was carried out as in the case of Step-g of Examples 1 through 7.

When the device was tested for performance, it showed a value of ΔIe/<Ie>=5.0%.

EXAMPLE 10, COMPARATIVE EXAMPLE 5

Figure 17:
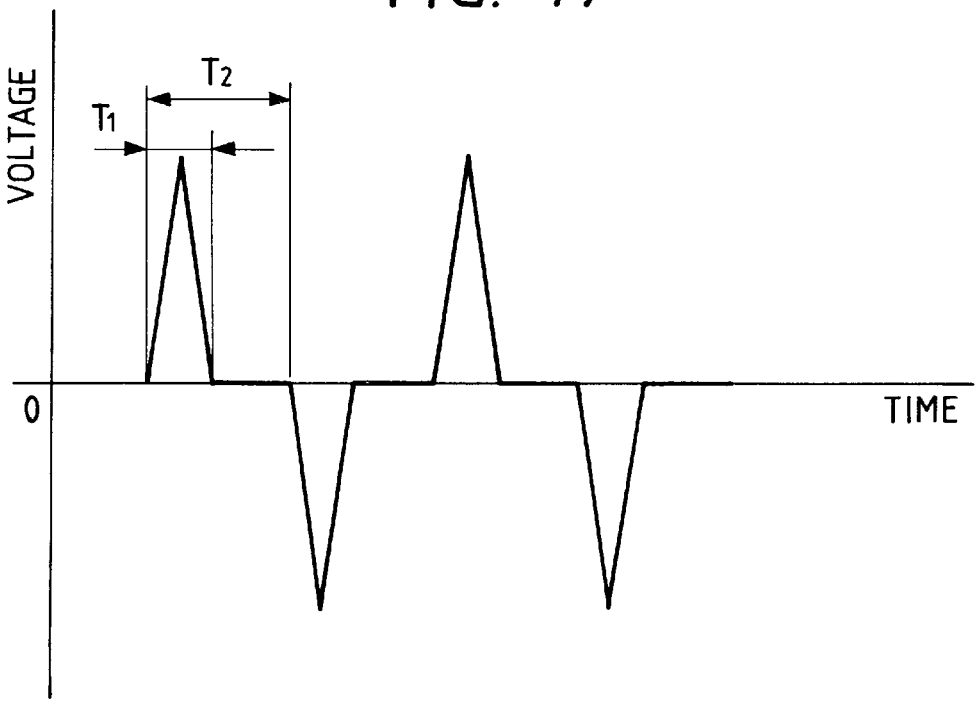
FIG. 17 is a graph showing the waveform of a pulse voltage that can be used for the purpose of the present invention.

The steps up to Step-d of Examples 1 through 7 were followed. Subsequently,

Step-e:

$SiH_4$ and a tiny amount of $PH_3$ were introduced into the vacuum chamber and a pulse voltage was applied to the device as in the case of Example 3. However, the polarity of the pulse was alternatingly changed as shown in FIG. 17. The values for T1 and T2 and the pulse wave height were same as those of Example 3. This step was omitted for Comparative Example 5.

Step-f:

After evacuating the vacuum chamber 26, $WF_6$ was introduced to raise the internal pressure to $1.3\times10^{-1}$ Pa and then a pulse voltage was applied to the device for 30 minutes. The polarity of the pulse voltage was inverted relative to that of the pulse voltage used for electron emission so that mainly a film 9 of W was formed on the border of the electron-emitting region and the lower potential side electroconductive thin film 4. A pulse wave height of 18.0 V was used.

The prepared device was then subjected to a test to see its performance as in the case of Examples 1 through 7 above to find out the device of Example 10 showed a value of ΔIe/<Ie>=4.9%, whereas the device of Comparative Example 5 showed a value of ΔIe/<Ie>=10.3%.

The devices of Example 3 and this example were made to emit electrons for a prolonged period of time for comparison. The device of this example showed a lower decreasing rate of electron emission. This may be because of the film of W formed in the device of this example in place of the film of a carbon compound of the device of Example 3.

EXAMPLE 11

In this example, an electron source was prepared by arranging a large number of electron-emitting devices like those formed in the preceding examples and wiring them with a matrix of wires and then an image-forming apparatus was realized by using the electron source.

Figure 18:
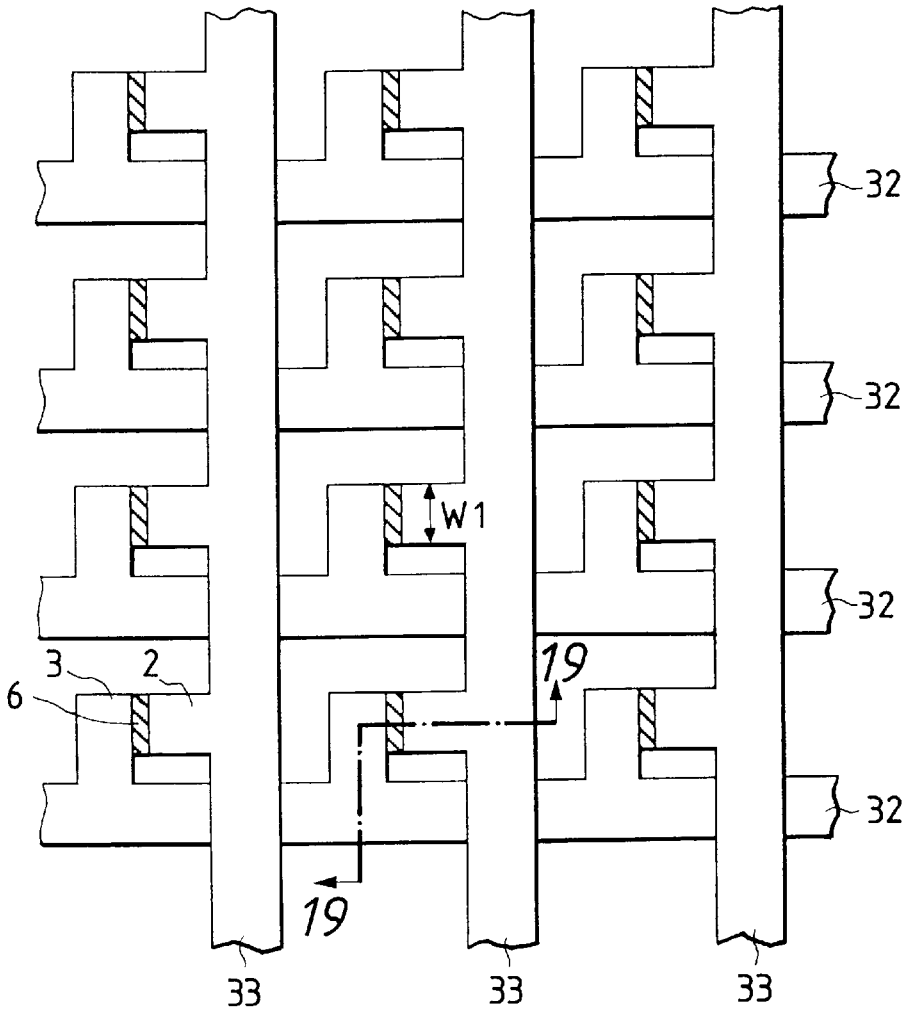
FIG. 18 is a schematic partial plan view of an electron source having a matrix wiring arrangement.
Figure 19:
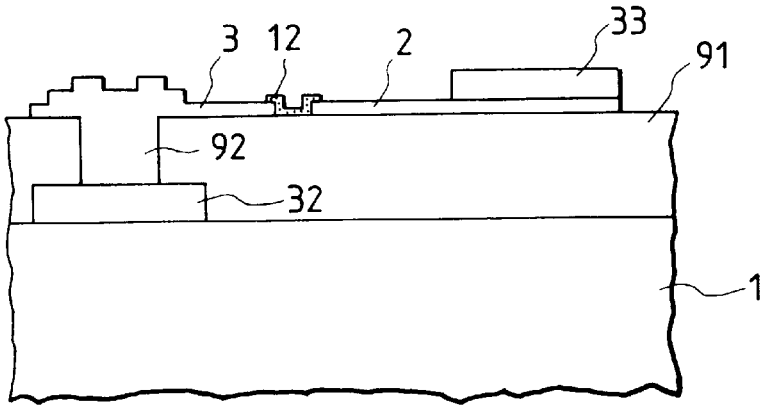
FIG. 19 is a schematic partial cross sectional view of the electron source of FIG. 18 taken along line 19—19.
Figure 20A:
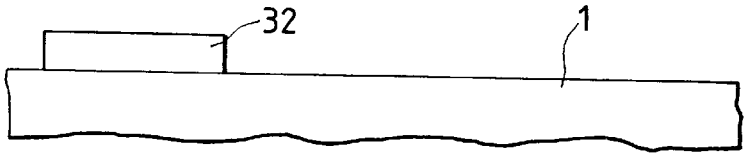
FIGS. 20A through 20H are schematic partial cross sectional views of an electron source having a matrix wiring arrangement, showing different manufacturing steps.
Figure 20B:
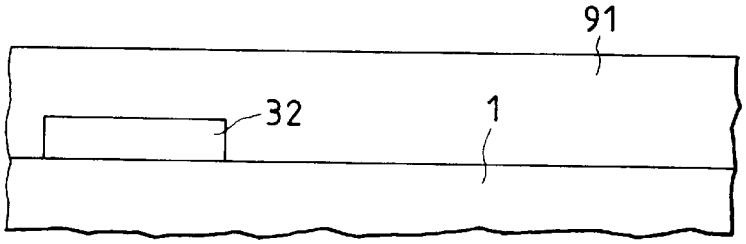
Figure 20C:
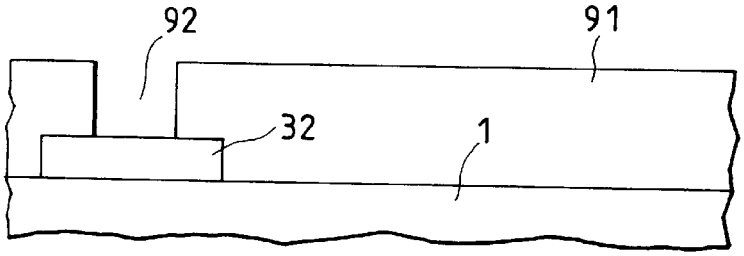
Figure 20D:
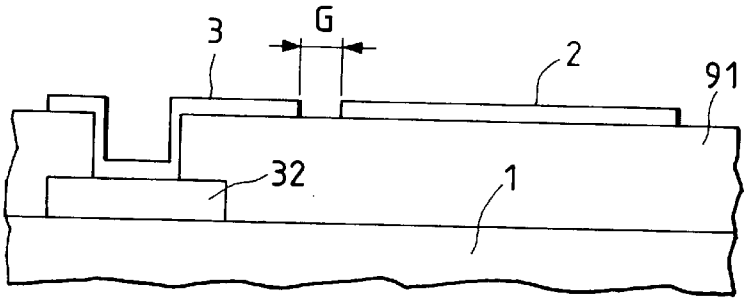
Figure 20E:
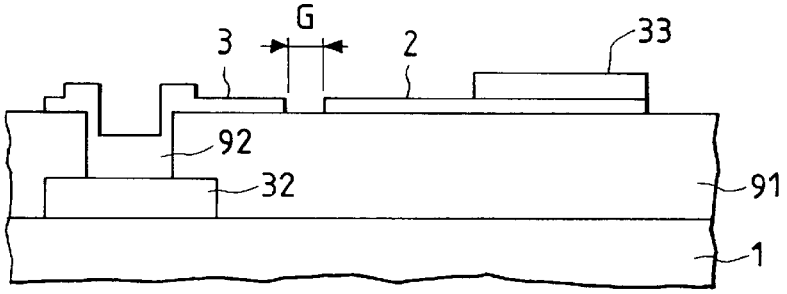
Figure 20F:
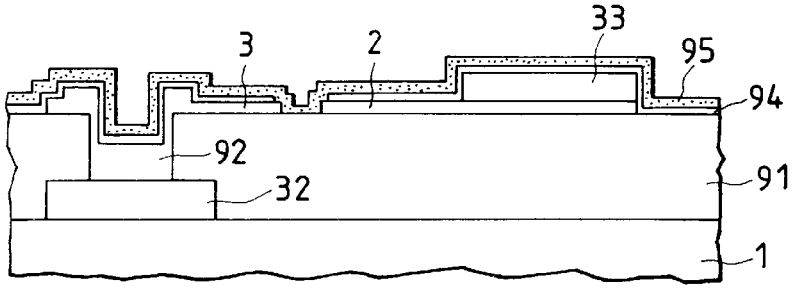
Figure 20G:
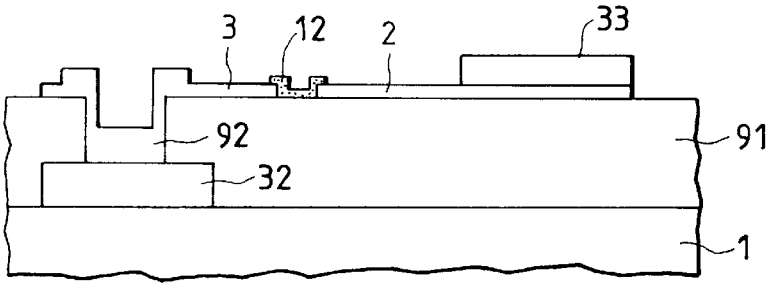
Figure 20H:
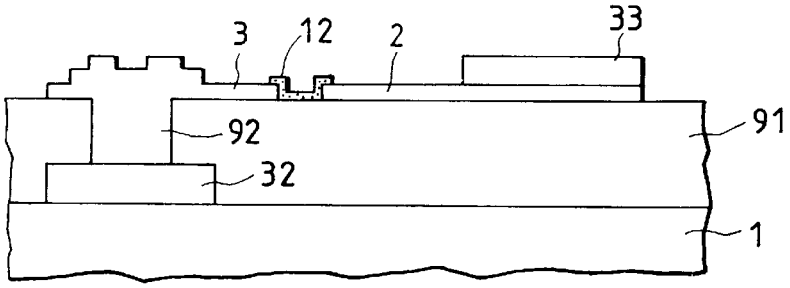

FIG. 18 is an enlarged schematic plan view of part of the electron source of this example. FIG. 19 is a schematic sectional view taken along line 19—19 in FIG. 18. FIGS. 20A through 20H show different manufacturing steps of the device of FIG. 19.

In these figures, reference numeral 1 denotes a substrate and reference numerals 32 and 33 respectively denote an X-directional wire a Y-directional wire, while reference numerals 2 and 3 denote device electrodes and reference numeral 6 denotes an electron-emitting region. Reference numeral 91 denotes an interlayer insulation layer and reference numeral 92 denotes a contact hole for electrically connecting a device electrode 3 and an X-directional wire 32.

Now, the method used for manufacturing the electron source will be described in terms of an electron-emitting device thereof by referring to FIGS. 20A through 20H. Note that the following manufacturing steps, or Step-A through Step-H, respectively correspond to FIGS. 20A through 20H.

Step-A:

After thoroughly cleansing a soda lime glass plate a silicon oxide film was formed thereon to a thickness of 0.5 μm by sputtering to produce a substrate 1, on which Cr and Au were sequentially laid to thicknesses of 5 nm and 600 nm respectively and then a photoresist (AZ1370: available from Hoechst Corporation) was formed thereon by means of a spinner, while rotating the film, and baked. Thereafter, a photo-mask image was exposed to light and photochemically developed to produce a resist pattern for an X-directional wires 32 and then the deposited Au/Cr film was wet-etched, followed by removal of the resist pattern, to actually produce an X-directional wires 32.

Step-B:

A silicon oxide film was formed as an interlayer insulation layer 91 to a thickness of 1.0 μm by RF sputtering.

Step-C:

A photoresist pattern was prepared for producing a contact hole 92 in the silicon oxide film deposited in Step-B, which contact hole 92 was then actually formed by etching the interlayer insulation layer 91, using the photoresist pattern for a mask. A technique of RIE (Reactive Ion Etching) using $CF_4$ and $H_2$ gas was employed for the etching operation.

Step-D:

Thereafter, a pattern of photoresist (RD-2000N-41: available from Hitachi Chemical Co., Ltd.) was formed for a pair of device electrodes 2 and 3 and a gap G separating the electrodes and then Ti and Ni were sequentially deposited thereon respectively to thicknesses of 5 nm and 100 nm by vacuum evaporation. The photoresist pattern was dissolved into an organic solvent and the Ni/Ti deposit film was treated by using a lift-off technique to produce a pair of device electrodes 2 and 3 having a width of W1=300 μm and separated from each other by a distance (gap) of G=3 μm.

Step-E:

After forming a photoresist pattern (negative pattern) for a Y-directional wire, Ti and Au were sequentially deposited by vacuum evaporation to respective thicknesses of 5 nm and 500 nm and then unnecessary areas were removed by means of a lift-off technique to actually produce a Y-directional wire 33 having a desired profile.

Step-F:

Then, a Cr film 94 was formed to a film thickness of 100 nm by vacuum evaporation and processed to show a pattern having an opening corresponding to the profile of the electroconductive thin film 12. A solution of Pd amine complex (ccp4230) was applied to the Cr film by means of a spinner and baked at 300° C. for 10 minutes to produce an electroconductive thin film 95 made of PdO fine particles and having a film thickness of 10 nm.

Step-G:

The Cr film 94 was removed along with any unnecessary portions of the electroconductive film 95 of PdO fine particles by wet etching, using an etchant to produce an electroconductive thin film 12 having a desired profile. The electroconductive thin film showed an electric resistance of $Rs=5\times10^4$ Ω/□.

Step-H:

Then, a photoresist layer was formed on the entire surface area except the contact hole 92 was prepared and Ti and Au were sequentially deposited by vacuum evaporation to respective thicknesses of 5 nm and 500 nm. The photoresist layer was solved into an organic solvent and any unnecessary areas were removed by means of a lift-off technique to consequently bury the contact hole 94.

Step-I:

This step and the subsequent steps will be described by referring to FIGS. 9, 10A and 10B.

After securing an electron source substrate 31 onto a rear plate 41, a face plate 46 (carrying a fluorescent film 44 and a metal back 45 on the inner surface of a glass substrate 43) was arranged above the substrate 31 by 5 mm with a support frame 42 disposed therebetween and, subsequently, frit glass was applied to the contact areas of the face plate 46, the support frame 42 and the rear plate 41 and baked at 400° C. in the atmosphere for 10 minutes to hermetically seal the container. The substrate 31 was also secured to the rear plate 41 by means of frit glass.

While the fluorescent film 44 is consisted only of a fluorescent body if the apparatus is for black and white images, the fluorescent film 44 of this example was prepared by forming black stripes in the first place and filling the gaps with stripe-shaped fluorescent members of primary colors. The black stripes were made of a popular material containing graphite as a principal ingredient. A slurry technique was used for applying fluorescent materials onto the glass substrate 43.

A metal back 45 is arranged on the inner surface of the fluorescent film 44. After preparing the fluorescent film, the metal back 45 was prepared by carrying out a smoothing operation (normally referred to as "filming") on the inner surface of the fluorescent film and thereafter forming thereon an aluminum layer by vacuum evaporation.

While a transparent electrode (not shown) might be arranged on the outer surface of the fluorescent film 44 of the face plate 46 in order to enhance its electroconductivity, it was not used in this example because the fluorescent film showed a sufficient degree of electroconductivity by using only a metal back.

For the above bonding operation, the components were carefully aligned in order to ensure an accurate positional correspondence between the color fluorescent members and the electron-emitting devices.

Figure 21:
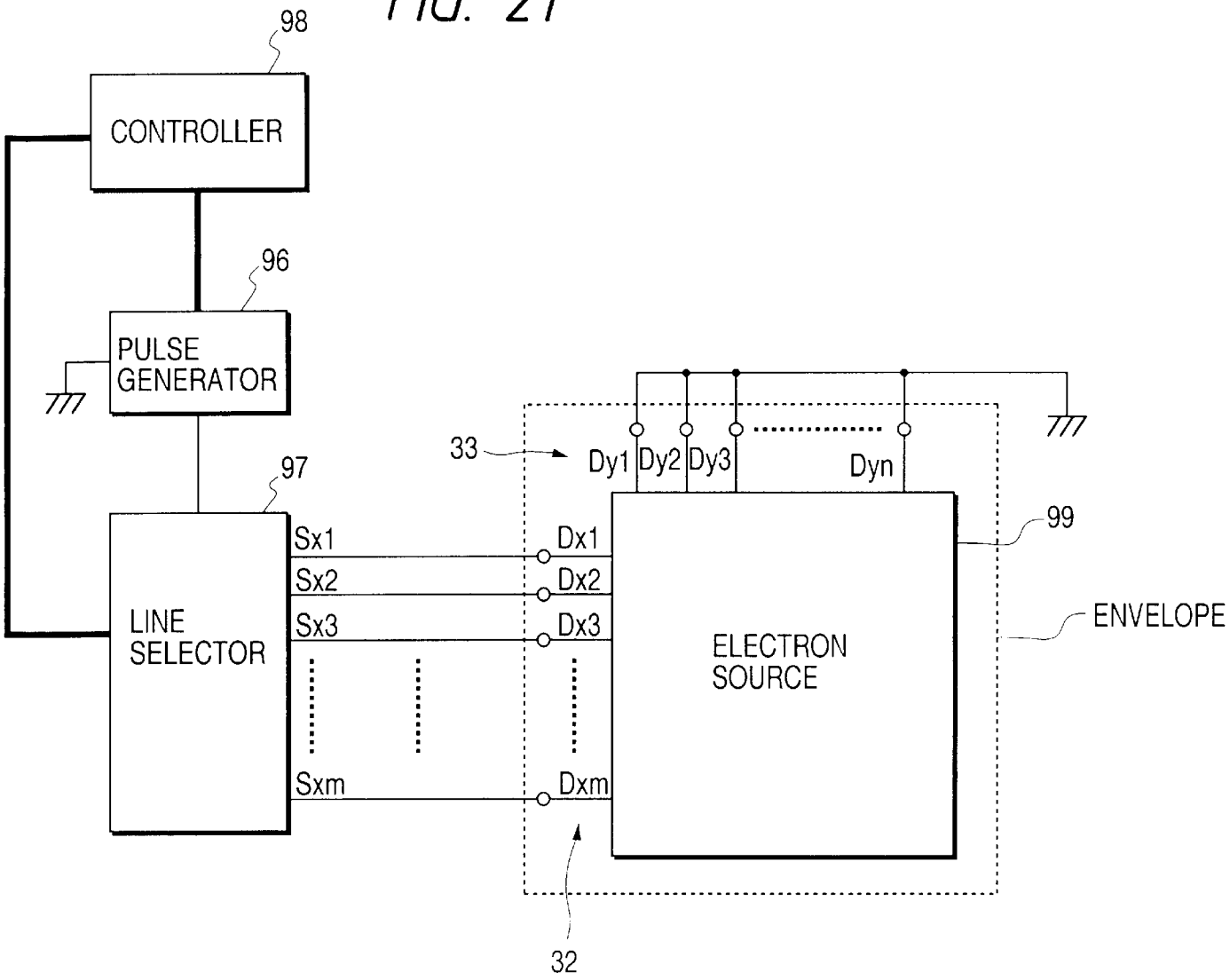
FIG. 21 is a schematic block diagram of a circuit used for an energization forming process in Example 11.

Step-J:

The image forming apparatus was then placed in a vacuum processing system shown in FIG. 12 and the vacuum chamber 63 was evacuated to reduced the internal pressure to less than $2.6\times10^{-3}$ Pa. FIG. 21 shows a diagram of the wiring arrangement used for the forming operation in this example. Referring to FIG. 21, a pulse generated by a pulse generator 96 is applied to one of the X-directional wires 32 selected by a line selector 97. Both the pulse generator 96 and the line selector 97 are controlled for operation by a control unit 98. The Y-directional wires 33 of the electron source 99 are connected together and grounded. The thick solid line in FIG. 21 represents a control line, whereas thin solid lines represent so many wires. The applied pulse voltage had a triangular pulse wave form with an increasing wave height as shown in FIG. 5B. As in the case of Example 1, a rectangularly parallelepipedic pulse voltage having a wave height of 0.1 V was inserted into intervals of the triangular pulse to gauge the resistance of each device row and the forming operation was terminated for the row when the resistance exceeded 1 MΩ for each device of the row.

Then, the voltage applying line was switched to a next line by the line selector. The pulse wave height was about 7.0 V for all the lines when the forming operation was terminated.

Step-K:

Dimethylaluminum hydride was introduced into the envelope 47 through the vacuum chamber 63 and the exhaust pipe 62, using oxygen as a carrier gas, until the internal pressure was raised to $1.3\times10^{-1}$ Pa. The wiring arrangement used for the forming process was also used here to apply a pulse voltage and produce an aluminum oxide film. The pulse wave height of the applied voltage was 14 V and the polarity was alternatingly changed as shown in FIG. 17.

Step-L:

The envelope 47 was evacuated and, thereafter, $MoF_6$ was introduced into the envelope until the internal pressure was reduced to $1.3\times10^{-1}$ Pa. A pulse voltage was applied to produce an Mo film 9 as in the case of Step-K above.

Step-M:

The envelope 47 was evacuated again to reduce the internal pressure to lower than $1.3\times10^{-4}$ Pa and the exhaust pipe 62 was heated to melt and hermetically seal the envelope. Finally, the getter (not shown) arranged in the envelope was heated by high frequency heating to carry out a getter process.

The image-forming apparatus produced after the above steps operated excellently to display fine images.

EXAMPLE 12

Figure 22:
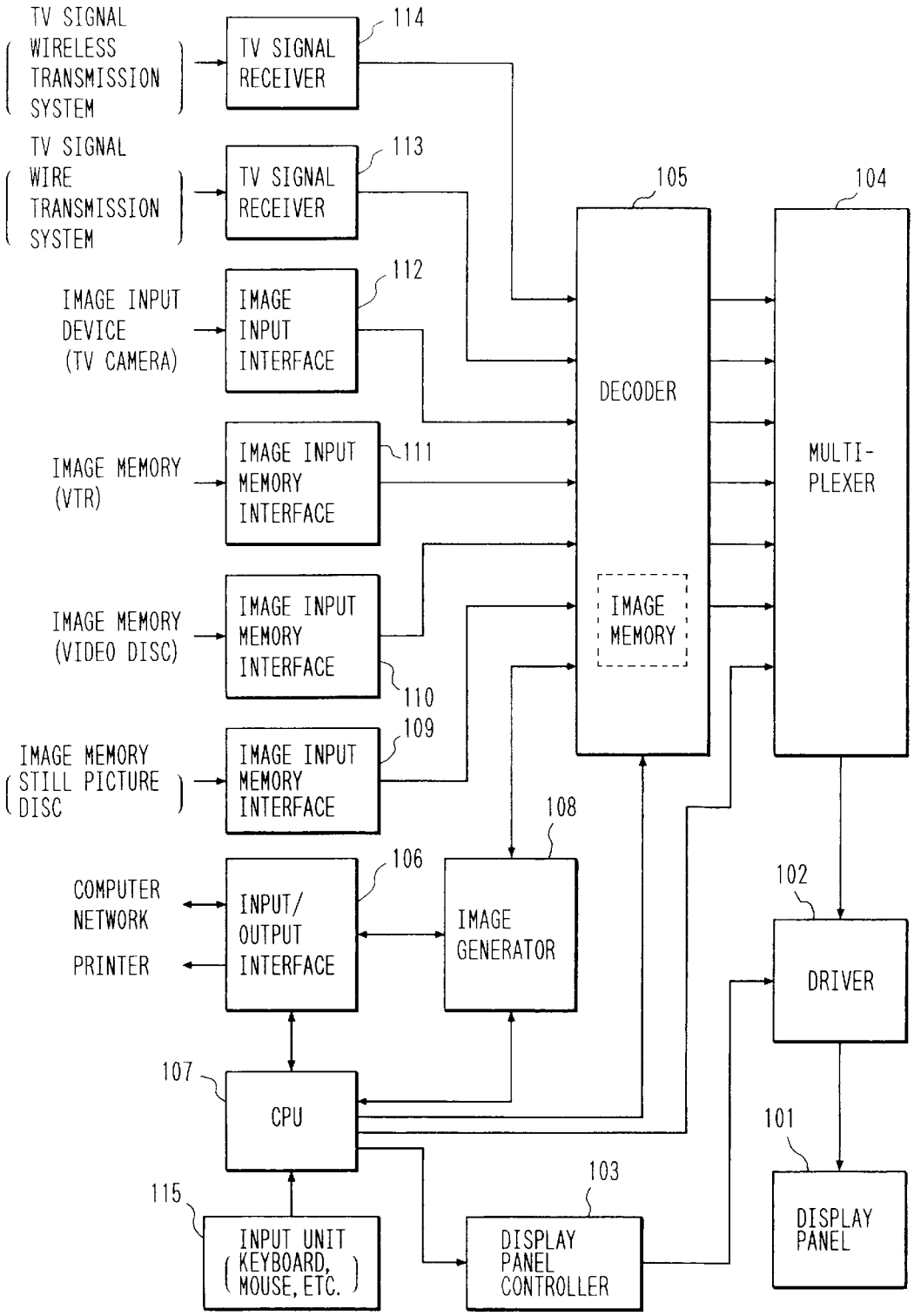
FIG. 22 is a schematic block diagram of an image display system realized by using an image-forming apparatus according to the invention.
Figure 23:
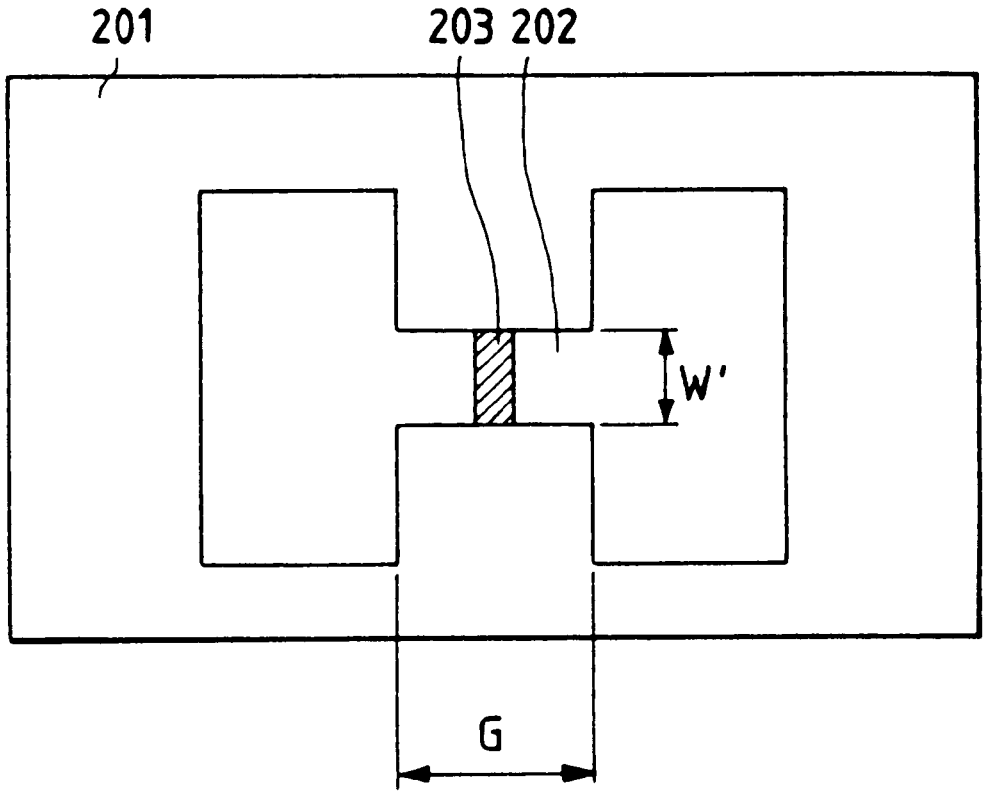
FIG. 23 PRIOR ART
FIG. 23 is a schematic plan view of a device described by M. Hartwell.

FIG. 22 is a block diagram of a display apparatus realized by using a method according to the invention and a display panel prepared in Example 11 and arranged to provide visual information coming from a variety of sources of information including television transmission and other image sources.

In FIG. 22, there are shown a display panel 101, a display panel driver 102, a display panel controller 103, a multiplexer 104, a decoder 105, an input/output interface circuit 106, a CPU 107, an image generator 108, image input memory interface circuits 109, 110 and 111, an image input interface circuit 112, TV signal receivers 113 and 114 and an input unit 115. (If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.)

Now, the components of the apparatus will be described, following the flow of image signals therethrough.

Firstly, the TV signal receiver 114 is a circuit for receiving TV image signals transmitted via a wireless transmission system using electromagnetic waves and/or spatial optical telecommunication networks. The TV signal system to be used is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel 101 comprising a large number of pixels. The TV signals received by the TV signal receiver 114 are forwarded to the decoder 105.

The TV signal receiver 113 is a circuit for receiving TV image signals transmitted via a wired transmission system using coaxial cables and/or optical fibers. Like the TV signal receiver 114, the TV signal system to be used is not limited to a particular one and the TV signals received by the circuit are forwarded to the decoder 105.

The image input interface circuit 112 is a circuit for receiving image signals forwarded from an image input device such as a TV camera or an image pick-up scanner. It also forwards the received image signals to the decoder 105.

The image input memory interface circuit 111 is a circuit for retrieving image signals stored in a video tape recorder (hereinafter referred to as VTR) and the retrieved image signals are also forwarded to the decoder 105.

The image input memory interface circuit 110 is a circuit for retrieving image signals stored in a video disc and the retrieved image signals are also forwarded to the decoder 105.

The image input memory interface circuit 109 is a circuit for retrieving image signals stored in a device for storing still image data such as so-called still disc and the retrieved image signals are also forwarded to the decoder 105.

The input/output interface circuit 106 is a circuit for connecting the display apparatus and an external output signal source such as a computer, a computer network or a printer. It carries out input/output operations for image data and data on characters and graphics and, if appropriate, for control signals and numerical data between the CPU 107 of the display apparatus and an external output signal source.

The image generation circuit 108 is a circuit for generating image data to be displayed on the display screen on the basis of the image data and the data on characters and graphics input from an external output signal source via the input/output interface circuit 106 or those coming from the CPU 107. The circuit comprises reloadable memories for storing image data and data on characters and graphics, read-only memories for storing image patterns corresponding to given character codes, a processor for processing image data and other circuit components necessary for the generation of screen images.

Image data generated by the image generation circuit 108 for display are sent to the decoder 105 and, if appropriate, they may also be sent to an external circuit such as a computer network or a printer via the input/output interface circuit 106.

The CPU 107 controls the display apparatus and carries out the operation of generating, selecting and editing images to be displayed on the display screen.

For example, the CPU 107 sends control signals to the multiplexer 104 and appropriately selects or combines signals for images to be displayed on the display screen. At the same time it generates control signals for the display panel controller 103 and controls the operation of the display apparatus in terms of image display frequency, scanning method (e.g., interlaced scanning or non-interlaced scanning), the number of scanning lines per frame and so on.

The CPU 107 also sends out image data and data on characters and graphic directly to the image generation circuit 108 and accesses external computers and memories via the input/output interface circuit 106 to obtain external image data and data on characters and graphics. The CPU 107 may additionally be so designed as to participate other operations of the display apparatus including the operation of generating and processing data like the CPU of a personal computer or a word processor. The CPU 107 may also be connected to an external computer network via the input/output interface circuit 106 to carry out computations and other operations, cooperating therewith.

The input unit 115 is used for forwarding the instructions, programs and data given to it by the operator to the CPU 107. As a matter of fact, it may be selected from a variety of input devices such as keyboards, mice, joysticks, bar code readers and voice recognition devices as well as any combinations thereof.

The decoder 105 is a circuit for converting various image signals input via said circuits 108 through 114 back into signals for three primary colors, luminance signals and I and Q signals. Preferably, the decoder 105 comprises image memories as indicated by a dotted line in FIG. 22 for dealing with television signals such as those of the MUSE system that require image memories for signal conversion. The provision of image memories additionally facilitates the display of still images as well as such operations as thinning out, interpolating, enlarging, reducing, synthesizing and editing frames to be optionally carried out by the decoder 105 in cooperation with the image generation circuit 108 and the CPU 107.

The multiplexer 104 is used to appropriately select images to be displayed on the display screen according to control signals given by the CPU 107. In other words, the multiplexer 104 selects certain converted image signals coming from the decoder 105 and sends them to the drive circuit 102. It can also divide the display screen in a plurality of frames to display different images simultaneously by switching from a set of image signals to a different set of image signals within the time period for displaying a single frame.

The display panel controller 103 is a circuit for controlling the operation of the drive circuit 102 according to control signals transmitted from the CPU 107.

Among others, it operates to transmit signals to the drive circuit 102 for controlling the sequence of operations of the power source (not shown) for driving the display panel in order to define the basic operation of the display panel. It also transmits signals to the drive circuit 102 for controlling the image display frequency and the scanning method (e.g., interlaced scanning or non-interlaced scanning) in order to define the mode of driving the display panel.

If appropriate, the display panel controller 103 transmits control signals for controlling the quality of the image being displayed in terms of brightness, contrast, color tone and/or sharpness of the image to the drive circuit 102.

The drive circuit 102 is a circuit for generating drive signals to be applied to the display panel 101. It operates according to image signals coming from said multiplexer 104 and control signals coming from the display panel controller 103.

A display apparatus according to the invention and having a configuration as described above and illustrated in FIG. 22 can display on the display panel 101 various images given from a variety of image data sources. More specifically, image signals such as television image signals are converted back by the decoder 105 and then selected by the multiplexer 104 before sent to the drive circuit 102. On the other hand, the display controller 103 generates control signals for controlling the operation of the drive circuit 102 according to the image signals for the images to be displayed on the display panel 101. The drive circuit 102 then applies drive signals to the display panel 101 according to the image signals and the control signals. Thus, images are displayed on the display panel 101. All the above described operations are controlled by the CPU 107 in a coordinated manner.

As described above in detail, the present invention provides a electron-emitting device that operates stably for electron emission as well as an electron source comprising a large number of such devices and an image-forming apparatus incorporating such an electron source that can display images of excellent quality.

What is claimed is:

1. An electron-emitting device comprising a pair of electrodes, an electro conductive thin film arranged between and connected to said electrodes, said electro conductive thin film containing a fissure so that a high potential one-side part and a low potential other-side part of the electro conductive thin film are arranged with respect to the fissure and a laminate film of semiconductor or metal oxide layer and carbon or carbon compound layer coated on a fissure forming end of at least one of the high potential one-side part and the low potential other-side of the electroconductive thin film.

2. An electron-emitting device according to claim 1, wherein said device is a surface conduction electron-emitting device.

3. An electron source comprising a plurality of electron-emitting devices arranged as connected to wires on a substrate, wherein said the electron-emitting devices are those defined in claim 1.

4. An electron source according to claim 3, wherein the resistance of the laminate film provided to said electron-emitting devices is greater than the resistance of the wires connected to said plurality of electron-emitting devices.

5. An image-forming apparatus comprising an electron source formed by arranging a plurality of electron-emitting devices as connected to wires on a substrate and an image-forming member for producing images upon being irradiated by electron beams emitted from said electron source, wherein said the electron-emitting devices are those defined in claim 1.

6. An image-forming apparatus according to claim 5, wherein the resistance of the laminate film provided to said electron-emitting devices is greater than the resistance of the wires connected to said plurality of electron-emitting devices.

7. An electron-emitting device according to claim 1, wherein said laminate film is provided on both fissure forming ends of the high potential one-side part and the low potential other-side part of the electro conductive thin film.

8. An electron-emitting device according to claim 1, wherein the laminate film has a structure of the carbon or carbon compound layer laminated on the semiconductor or metal oxide layer.

* * * * *

UNITED STATES PATENT AND TRADEMARK OFFICE

CERTIFICATE OF CORRECTION

PATENT NO. : 5,986,389

DATED : November 16, 1999

INVENTOR(S) : TAKEO TSUKAMOTO

It is certified that error appears in the above-identified patent and that said Letters Patent is hereby corrected as shown below:

COLUMN 5

Line 23, "Ie 'and" should read --Ie, and--.

COLUMN 6

Line 9, "shows" should read --show--.

COLUMN 7

Line 64, "cluster." should read --cluster."--.

COLUMN 11

Line 36, "an" should read --a--.

COLUMN 13

Line 15, "used." should read --be used.--.

UNITED STATES PATENT AND TRADEMARK OFFICE

CERTIFICATE OF CORRECTION

PATENT NO. : 5,986,389

DATED : November 16, 1999

INVENTOR(S) : TAKEO TSUKAMOTO

It is certified that error appears in the above-identified patent and that said Letters Patent is hereby corrected as shown below:

COLUMN 31

Line 12, "said the" should read --said--.

Signed and Sealed this

Twenty-first Day of November, 2000

*Attest:*

Q. TODD DICKINSON

*Attesting Officer*

*Director of Patents and Trademarks*